US011685476B2

(12) United States Patent
McGarian et al.

(10) Patent No.: US 11,685,476 B2
(45) Date of Patent: Jun. 27, 2023

(54) SHIP SECURITY BARRIER

(71) Applicant: GLOBAL SHIELDTECH LTD, Aberdeenshire (GB)

(72) Inventors: Bruce McGarian, Stonehaven (GB); Stuart Yorke, Angus (GB)

(73) Assignee: GLOBAL SHIELDTECH LTD, Aberdeenshire (GB)

( * ) Notice: Subject to any disclaimer, the term of this patent is extended or adjusted under 35 U.S.C. 154(b) by 1068 days.

(21) Appl. No.: 16/329,999

(22) PCT Filed: Aug. 23, 2017

(86) PCT No.: PCT/GB2017/052489

§ 371 (c)(1),
(2) Date: Mar. 1, 2019

(87) PCT Pub. No.: WO2018/042162

PCT Pub. Date: Mar. 8, 2018

(65) Prior Publication Data

US 2019/0202528 A1 Jul. 4, 2019

(51) Int. Cl.
*B63B 17/04* (2006.01)
*B63G 13/00* (2006.01)
(Continued)

(52) U.S. Cl.
CPC ..... *B63B 17/04* (2013.01); *B63G 13/00* (2013.01); *E04H 17/003* (2013.01); *B63B 3/10* (2013.01)

(58) Field of Classification Search
CPC ... B63B 17/00; B63B 17/04; B63B 2017/045; B63B 13/00; B63B 3/10; B63B 59/00;
(Continued)

(56) References Cited

U.S. PATENT DOCUMENTS 9,359,051 B2 * 6/2016 Stevens ..... B63B 17/04
2012/0060744 A1 * 3/2012 DiBruno, Sr. ..... B63G 13/00 114/361
2016/0140561 A1 5/2016 Cowan

FOREIGN PATENT DOCUMENTS

CN 201472648 U 5/2010
CN 102649469 A 8/2012
(Continued)

OTHER PUBLICATIONS

Non-Final Office Action received for U.S. Appl. No. 16/044,710, dated Jul. 27, 2021, 29 pages.
(Continued)

*Primary Examiner* — Daniel V Venne
(74) *Attorney, Agent, or Firm* — Shook, Hardy & Bacon L.L.P.

(57) ABSTRACT

A ship security device is disclosed including a barrier and a panel. The security device may transition between a first configuration and a second configuration. In the first configuration the security device is unassembled and at least the barrier may be arranged in a storage configuration in which the barrier curves or bends through a first angle, and in the second configuration the security device is assembled in an arrangement for use, in which the security device may be assembled around a rail. In the second configuration at least a part of the panel is orientated to be substantially vertical, and the barrier is curved, bent or folded through a second angle, which is greater than the first angle, to protrude away from the panel in a horizontal direction, perpendicular from a plane extending vertically through the rail, to provide an overhang on an exterior side of the rail.

22 Claims, 27 Drawing Sheets

(51) Int. Cl.
*E04H 17/00* (2006.01)
*B63B 3/10* (2006.01)

(58) Field of Classification Search
CPC ..... B63B 59/02; E04H 17/003; E04H 17/004; F41H 13/00
USPC ..... 114/343, 361, 364
See application file for complete search history.

(56) References Cited

FOREIGN PATENT DOCUMENTS

| | | | |
|---|---|---|---|
| GB | 2496757 | A | 5/2013 |
| GB | 2524012 | A | 9/2015 |
| GB | 2526610 | A | 12/2015 |
| GB | 2533663 | A | 6/2016 |
| WO | 2006/060284 | A2 | 6/2006 |
| WO | 2007052156 | A2 | 5/2007 |

OTHER PUBLICATIONS

My Market Research, "Types of Data & Measurement Scales: Nominal, Ordinal, Interval and Ratio", Retrieved from the Internet URL: <https://web.archive.org/web/20150317080920/http://www.mymarketresearchmethods.com: 80/types-of-data-nominal-ordinal-interval-ratio>, Nov. 28, 2012, 7 pages.

Newsom, "Types of Scales & Levels of Measurement", Retrieved from the Internet URL: <https://web.archive.org/web/20170129235515/http://web.pdx.edu/~newsomj/pa551/lecture1.htm>>, Jan. 29, 2017, 4 pages.

International Search report and Written Opinion received for PCT Application No. PCT/GB2017/052489, dated Sep. 26, 2017, 8 pages.

International Preliminary Report on Patentability received for PCT Application No. PCT/GB2017/052489, dated Mar. 14, 2019, 7 pages.

* cited by examiner

SHIP SECURITY BARRIER

CROSS-REFERENCE TO RELATED APPLICATIONS

This application entitled "Security Barrier" is a 35 U.S.C. § 371 national stage application of PCT Application Number PCT/GB2017/052489, filed Aug. 23, 2017, and entitled "A Security Barrier", which claims priority to British Patent Application No. GB1614956.9, filed Sep. 2, 2016, and British Patent Application No. GB1706193.8, filed Apr. 19, 2017. The entirety of the aforementioned applications are incorporated by reference herein.

BACKGROUND

The invention relates to a security device and in particular concerns a device for improving the security of a ship. More specifically, the invention relates to a modular security device.

In recent years there have been several examples of commercial cargo ships being boarded by pirates. This type of event can present a serious threat to the wellbeing of the crew of the ship, as well as being commercially damaging.

As ship owners and operators have become increasingly aware of the problem, they have begun to improve the security of the ship by placing security barriers over the rails of the ship to make the ship more difficult to board. Removable bulwarks are attached to the peripheral edges of a ship, such as a ship's rail. The barrier element typically has a bulbous shape which provides an overhang when the device is attached to a ship's rail. The barrier is attached to a support element which attaches to the rail. Examples of such devices are disclosed in WO2013/072704 Stevens and WO2016/102926 McGarian.

One aim of the devices is to provide a smooth surface, so that hooks and ropes may not be attached to the exterior of the device, thereby making it difficult or impossible to climb up the side of the ship and board the ship. Another aim is to provide an overhang that is difficult to traverse, therefore even if the pirates are able to find a way to attach a ladder or rope to climb the side of a ship, they may be prevented from boarding the ship by the overhang.

However, such barriers are typically large and bulky and may not stack efficiently. Further, they may be expensive to manufacture due to the specific shape and requirements.

Accordingly, it is an object of the present invention to provide a security barrier that provides protection for the crew, but may also be efficiently stored.

Further, it is an object of the present invention to improve the manufacture of security barriers in terms of at least cost, efficiency and materials.

SUMMARY OF INVENTION

Aspects of the invention are set out in the accompanying claims.

One aspect of the invention provides a security device comprising: a barrier; and a panel, wherein the security device may be transitioned repeatedly between a first configuration and a second configuration, in the first configuration the security device is unassembled and at least the barrier may be arranged in a storage configuration in which the barrier curves or bends through a first angle, and in the second configuration the security device is assembled in an arrangement for use, in which the security device may be assembled around a rail; and wherein, in the second configuration, at least a part of the panel is orientated to be substantially vertical, and the barrier is curved, bent or folded through a second angle, which is greater than the first angle, to protrude away from the panel in a horizontal direction, perpendicular from a plane extending vertically through the rail, to provide an overhang on an exterior side of the rail.

Thus, a security device may be produced, possibly from one or more of material, and fastened together around a rail to assist in preventing unwanted persons to transverse the rail and to protect personnel on the inside of the railing.

At least part of the barrier may be made from a flexible material that may bend into a bulbous shape.

The barrier may comprise at least one living hinge so that the barrier bends or is folded preferentially along the hinge, preferably wherein the living hinge is formed from a mesh or a thinner portion of material.

The barrier may comprise one or more hinges to fold the barrier into a triangular cross-section.

The barrier and panel may each comprise a substantially planar sheet of material.

The barrier and panel may comprise a single substantially planar sheet of material.

When not in use, the device may be stored substantially flat. Accordingly, the device may be considered 'flat-packed'. This has advantages of stacking efficiently, enabling many devices to be stored together in a relatively small volume, either on land, on the deck of a ship or elsewhere. This efficiency in space may allow each ship to carry its own set of devices to deploy when necessary.

The barrier may comprise a comparatively rigid frame structure and a comparatively flexible shell, and the shell at least partially covers the frame, optionally wherein the frame structure comprises two end structures, and optionally the frame structure further comprises at least one removable brace member.

The panel may be made from a flexible material, or the panel may be made from a rigid material.

The panel may be curved or may be bent to curve around a rail, and preferably in the second configuration, at least some of the upper portion of the panel is on one side of the rail, and the lower portion of the panel is on the opposite side of the rail.

In use in the second configuration on a ship rail, the back panel may extend from the outer side of a fish plate which is located substantially directly below the rail, through the railing from the outer side to the inside of the railings, in an upward direction on the inside of the railings and over the top of the rail in a direction outwards from the ship.

The barrier and panel may be made from sheet plastic.

The barrier may be made from a different material compared to the panel, and the barrier is more flexible than the panel.

The shape of the device, once attached to the railings may be achieved with a number of different arrangements and using different materials, depending on the most suitable for the situation.

In the second configuration the panel and the barrier may overlap in a region proximal to the upper edge, and the panel stiffens the barrier.

The material of the barrier and or the panel may be stiffened or reinforced at one or more locations across the device to preferentially shape the device to a particular form.

Each of the barrier and the panel may have at least one series of attachment points for securing the barrier and the panel to each other, and preferably to a rail, and optionally wherein the at least one series of attachment points comprise a series of slots.

Thus, the device may be releasably secured to a railing or other perimeter wall. Different series of holes or slots may be used for different purposes. For example, some holes may be used to secure the device to the railing, while others may be used to attach the barrier and the panel together. Further, some slots may be used to attach the device to the lowest rail and others used to attach the device to the uppermost railing. Thus, when secured to the railing, the device will be prevented from rotating about the railing when a force is applied to the barrier.

In use, the panel and barrier may be adjustably positioned relative to each other to correspondingly adjust the overall height of the device.

Further, the device is flexible and may be adjustably fitted to a railing. Thus, the same device may be used on several different types of railings or barriers, with different dimensions. Further, the proportions of the device may be adjusted to specifically fit particular railings.

The device may further comprise at least one webbing strap for securing the barrier and the panel and hold the device in the second configuration, optionally a ratchet may be used with the at least one webbing strap to securely hold the ends of the strap and tighten the strap.

Securement straps or webbing may be used. More than one webbing strap may be used. In addition, each webbing strap may be chosen for a particular purpose. For example, a stronger and optionally wider strap may be used to pull the device into shape, while other straps may be used to hold the device once the shape has been achieved. Smaller straps may be used through a single portion of the device and around a single rail to prevent rotation of the device.

Preferably, the barrier has a free end with a first cooperation arrangement; the panel has a second cooperation arrangement partway along its length; and the first and second cooperation arrangements can be releasably attached together to hold the device in the second configuration.

At least one end of the barrier may have castellations and the panel will have corresponding slots for receiving the castellations.

In such an arrangement, the castellations and the corresponding slots may be used to assist in securely attaching the barrier to the panel at a specific location. The arrangement 'locks' the barrier to the panel in a specific shape, thus, assisting in maintaining the shape and integrity of the device if an external force is applied to the device.

The barrier may extend from a point at or near the top of the panel, protrude outwardly and return to meet panel at a location partway along the panel, wherein the angle at which the barrier meets the panel at this location is at least 20° away from being perpendicular to the plate of the panel at that location.

Further, the device may comprise an additional component to be attached to the device, wherein the additional component comprises an anti-ballistic plate.

Additional components can allow the device to provide additional protection. For example, anti-ballistic materials may be used to provide some protection against firearms. Such additional components may be used selectively and strategically where additional protection is required, for example around essential infrastructure.

In some embodiments, at least one rigid support bar may be used, positioned against a rail and supports the barrier portion in order to provide additional support to the device, in particular to the shape of the barrier. The support bar may comprise two members which are pivotally attached to each other. Thus, providing a scissor support which opens to an X shape. The 'legs' of the free ends of the support may be troughed shaped in order to fit neatly against a rail. In addition, or instead, the free ends of the support may be coated in a material, such as rubber, which provides high friction between the free end and the rail, to help keep the support bar in position.

Two or more security devices may be installed in a side-by-side arrangement, wherein in use respective sides of each of the security devices are positioned in close proximity to form a substantially continuous barrier.

An installation device may be used to assist in installing the one or more devices. The installation may be flexible, such as a rope, and used to pull the barrier and/or panel components into shape and position to be secured.

Starting from the first configuration, the barrier and the panel are placed in an overlapping arrangement and secured to each other using a fastener and a flexible installation member is attached to a free end of the barrier, the device is threaded through the railing leading with the barrier and above the lowest rail and a free end of the flexible installation member is held over the uppermost rail, the device is rotated until the panel is substantially vertical with the lower end of the panel on the outside of the rail and the upper end of the panel extending above the upper rail and on the inside of the rail, further, the securement between the panel and the barrier is located proximate to a middle rail, tension is applied to the flexible installation member to bend the barrier over the top of the panel and into a bulbous shape wherein the upper end of the panel and the free end of the barrier overlap with the panel inside the barrier, and the barrier and the panel are secured to each other and around the railing in the second configuration and the flexible installation member is removed.

According to another method of installing a security device, staring from the first configuration, the method has the steps of: securing a cross bar support to a railing; securing a barrier to a middle rail; securing a panel inboard of the barrier and to an upper rail; folding the panel over the cross bar; and wrapping the barrier over the cross bar and the panel, and securing the barrier.

When installed, adjacent devices may at least partially overlap to minimize gaps between devices. In order to secure overlapping devices in position, they may need to be installed in a particular sequence and/or one or more devices may need to be installed in parallel.

Thus, devices may be used together to protect a perimeter wall. Used together the devices can provide a continuous layer of protection.

As the device is made from readily available materials and each individual part has relatively simple construction, lost or missing parts may be easily replaced.

Due to the simplicity of the design, the device may be quickly deployed and assembled in the desired location should a need arise for additional protection. The device that is relatively light and strong. Additional features may be added to the basic device as required.

Other arrangements, variations and advantages will become apparent from the following description.

BRIEF DESCRIPTION OF THE FIGURES

In order that the present invention may be more readily understood, embodiments thereof will now be described, by way of example, with reference to the accompanying drawings, in which.

DETAILED DESCRIPTION OF INVENTION

Figure 1:
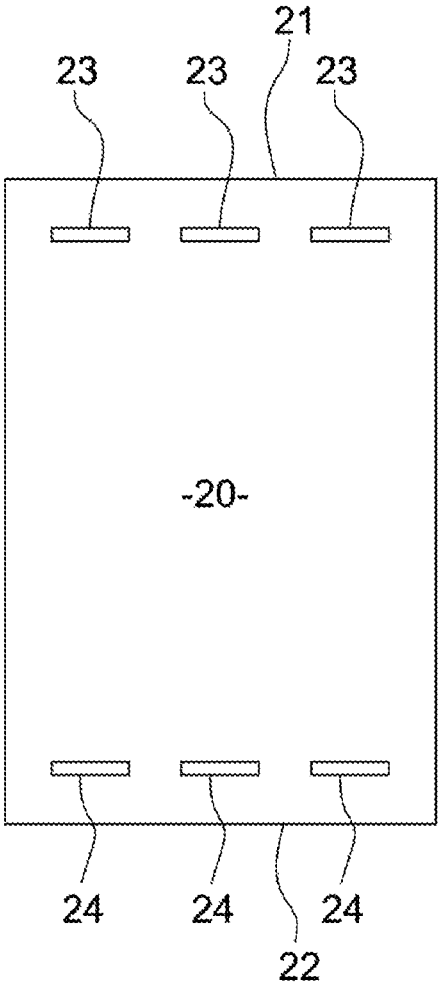
FIG. 1 illustrates a barrier in a first configuration.

In the specification terms such as 'upper', 'lower', 'height', 'length', 'width' and 'depth' are used. Terms such as 'vertical', 'horizontal', 'upwards', 'above', 'below', 'inboard' and 'outboard' refer to the components relative to their position when attached to a ship. It should be understood that these refer to the components when they are installed in the manner described and depicted herein, and not in any other orientation.

The invention relates to a security device. In overview, the security device has an inboard portion and a bulbous outboard portion to provide an overhang. A number of devices may be secured to the rails or walls of a ship, around the periphery or edge, to make it more difficult to gain access to the ship's deck.

As will be familiar to the skilled person, the deck of a ship typically has railings near its outer edge, comprising a top rail and at least one intermediate rail. These are raised above the surface of the deck. Typically rails have a height of 1 m and intermediate rails are spaced apart by a maximum of 38 cm. The bottom rail is typically less than 23 cm from the ship's deck. Typically, rail support stanchions are spaced 1.5 m apart. The decks of many ships also include a short upstanding fish plate or kick board which runs around the perimeter of the deck, at or near the edge thereof, substantially directly beneath the top rail, or offset slightly. The kick board performs the function, among others, of preventing dropped objects from rolling off the deck of the ship. On typical vessels the kick board may have a height of 100-150 mm. The fish plate (or kick board) not only stop objects rolling overboard, but also acts to 'save all' in the event that there is a liquid spillage on deck. This functionality is primarily used in port, harbour and coastal waters. A fish plate will typically include holes from the deck to the side of the ship which act as drains. These may be plugged or blocked to prevent drainage in port, harbour and coastal waters. When at sea, water will drain from these holes, for example, if there is heavy weather and a lot of water is on deck as a result, it will be allowed to run off over the fish plate, as water allowed to slosh from side to side as a vessel rolls is undesirable.

In a first embodiment shown in FIGS. 1 to 5, the device consists of two main parts: a barrier portion, which, in use, is outboard and provides the bulbous overhang, and a panel, which, in use, is secured to the barrier and assists with providing stability to the device and securing the barrier to a railing.

In a first configuration, the device is unassembled. The barrier portion comprises a generally rectangular sheet of plastic (or another suitable material). The width of the sheet corresponds to the width of the device. The length of the sheet will depend on the size of the overhang required and the height of the railings that the device is intended to be used on. The barrier has a number of slots cut through which are sized, shaped and positioned for assembling the device. Typically the slots will be elongated for receiving a strap or webbing.

FIG. 1 schematically illustrates a barrier 20. The barrier 20 comprises an upper edge 21 and a lower edge 22. The upper and lower edges 21, 22 correspond to the shorter edges of the rectangular shape of the barrier 20. Proximal to each of the upper and lower edges 21, 22 are a series of slots 23, 24. In the embodiment shown, the slots are elongated in a direction which is parallel or substantially parallel with the upper and lower edges 21, 22.

In the unassembled configuration, the panel comprises a generally rectangular sheet of plastic also. Similarly to the barrier portion, the width of the panel corresponds to the width of the device. The width of the panel and the barrier preferably correspond, and in advantageous embodiments are identical or substantially identical. The width of a panel and barrier may depend on stanchion spacing, on a ship. The length of the panel will depend on the size of the overhang required and the height of the railings that the device is intended to be used on. The panel has a number of slots cut through which are sized, shaped and positioned for assembling the device. Typically the slots will be elongated for receiving a strap or webbing. The panel may be made from a rigid material or a flexible material. When the panel is made from a rigid material, it has a specific shape for the intended use. When the panel is made from a flexible material, in an unassembled configuration, the panel will preferably be substantially planar.

Figure 2:
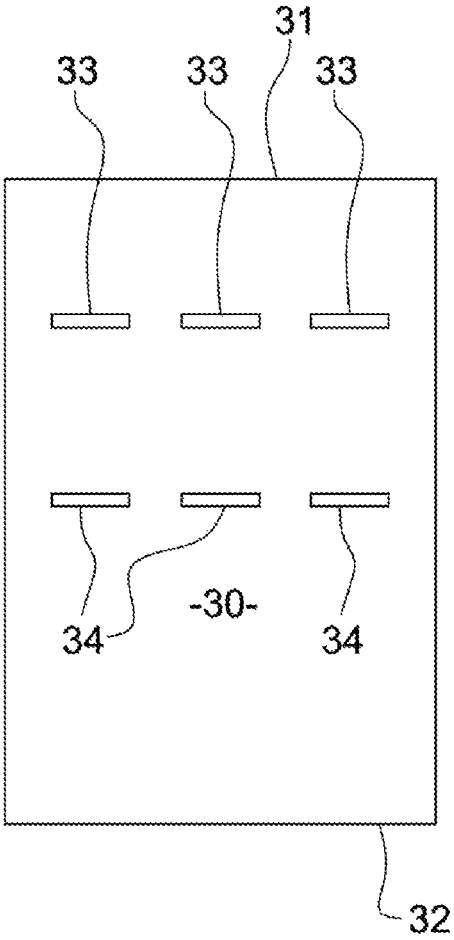
FIG. 2 illustrates a panel in a second configuration.

FIG. 2 illustrates a panel 30. The panel 30 comprises an upper edge 31 and a lower edge 32, and once again these correspond to the shorter edges of the rectangular shape of the panel 30. A first series of slots 33 are located a distance from the upper edge 31, and a second series of slots 34 are located around the mid-point of the length.

In FIGS. 1 and 2 the barrier 21 and panel 30 are shown to have the same height (i.e. length in the direction corresponding to the longer sides of the rectangular shapes thereof). However, this need not be the case, and it is expected that, in most embodiments, the barrier 21 will be longer than the panel 30.

In a second configuration, the device is assembled. Typically this will be around and attached to a rail on a ship. The panel is arranged around the rail. A lower edge of the panel extends to approximately the level of the deck, and the lower edge is preferably positioned on the outboard side of at least the lower rail, and preferably is outboard of the fish plate also. The bottom of the panel is arranged so that it overhangs the fish plate so that water on the deck of a ship may drain. When a flexible material is used, water force bears against the lower portion of the panel and the panel will deflect so that the device is 'self-draining'. The lower edge may extend below the deck if the edge is outboard of the outer wall of the ship. Following the panel upwardly from its lower edge, around a mid-point of the rail's height, the panel passes between two rails to the inboard side of the rail, typically between the lowest and next lowest rail. The panel then extends in a substantially vertical direction to the top of the rail. Therefore, the panel is arranged substantially vertically. The upper end portion of the panel curves in an outboard direction to extend in a substantially horizontal direction.

The barrier is attached to the panel. The lower edge of the barrier makes contact or near contact with the panel around a mid-point of the panel's height. The upper edge of the barrier is in contact with or attached to the panel a short distance below or beyond the upper edge of the panel. Thus, at the upper end of each of the barrier and the panel, the barrier and panel overlap for a distance. Between the lower edge of the barrier and the upper edge of the barrier, the barrier portion is curved. The barrier extends away from the panel in the outboard direction, and is generally positioned outboard of the rail. The barrier has bulbous shape and therefore provides an overhang towards the top of the railing.

Figure 3:
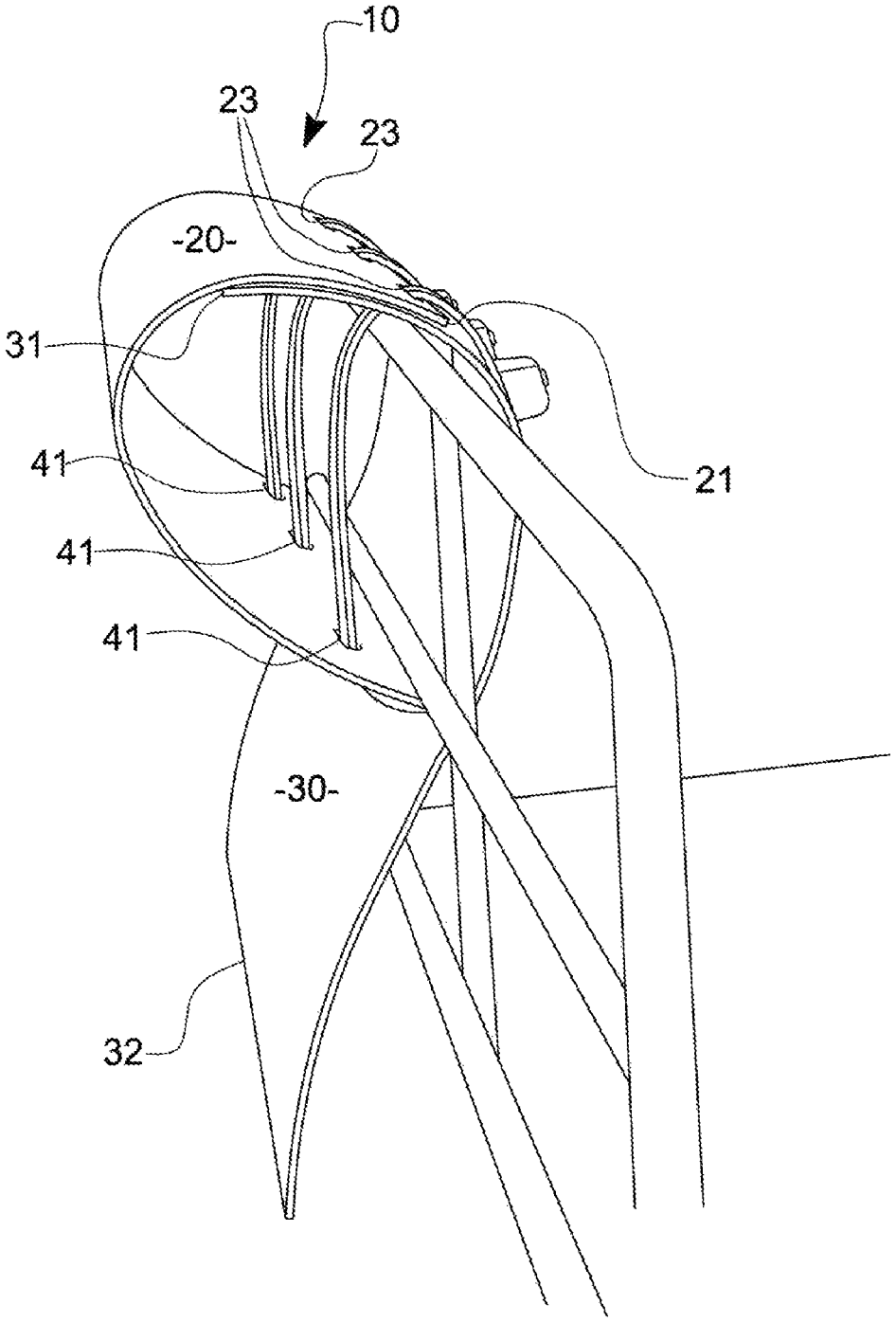
FIG. 3 illustrates a front-side perspective view of a security device in a second configuration.
Figure 4:
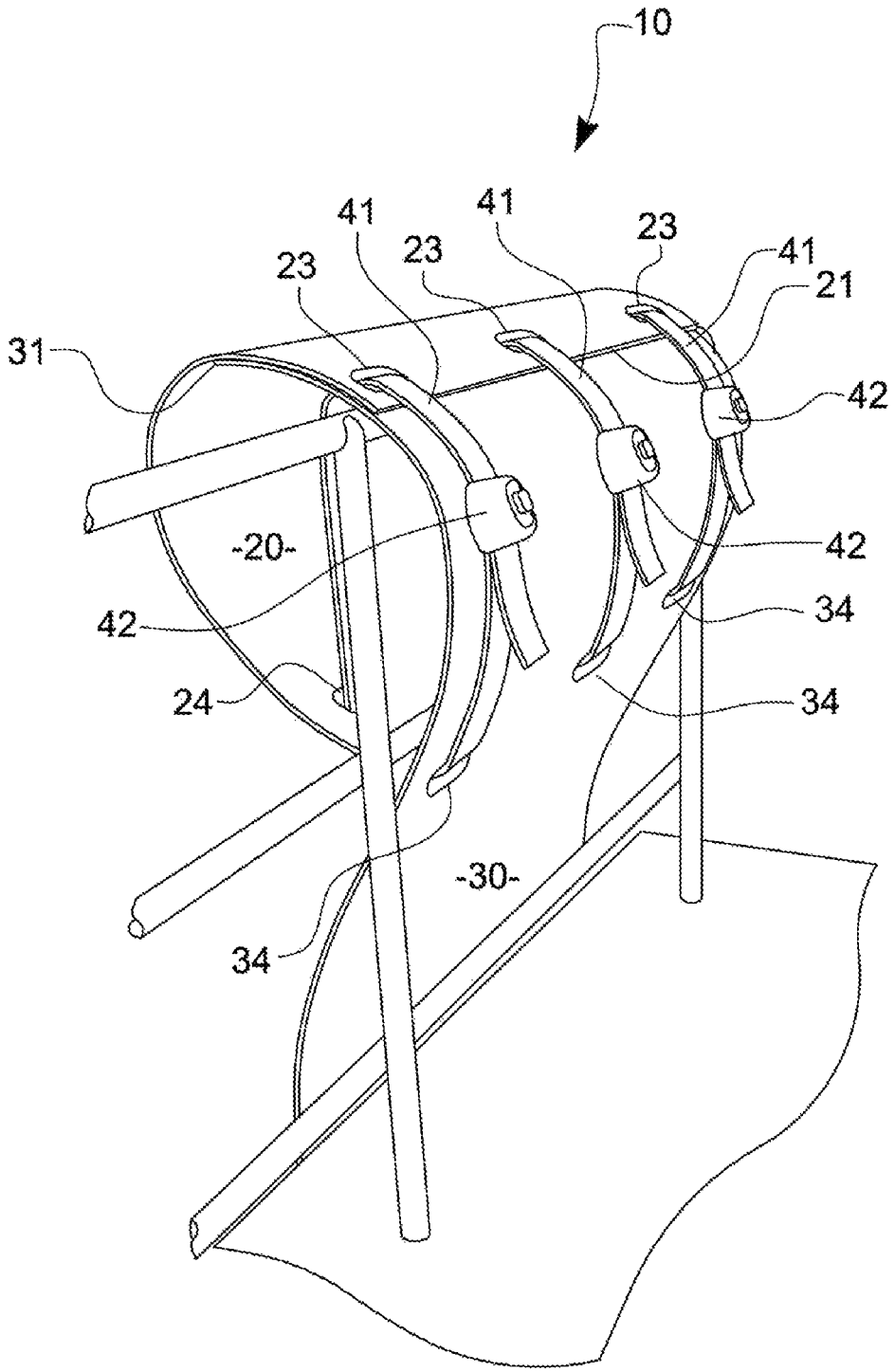
FIG. 4 illustrates a back-side perspective view of a security device in a second configuration.
Figure 5:
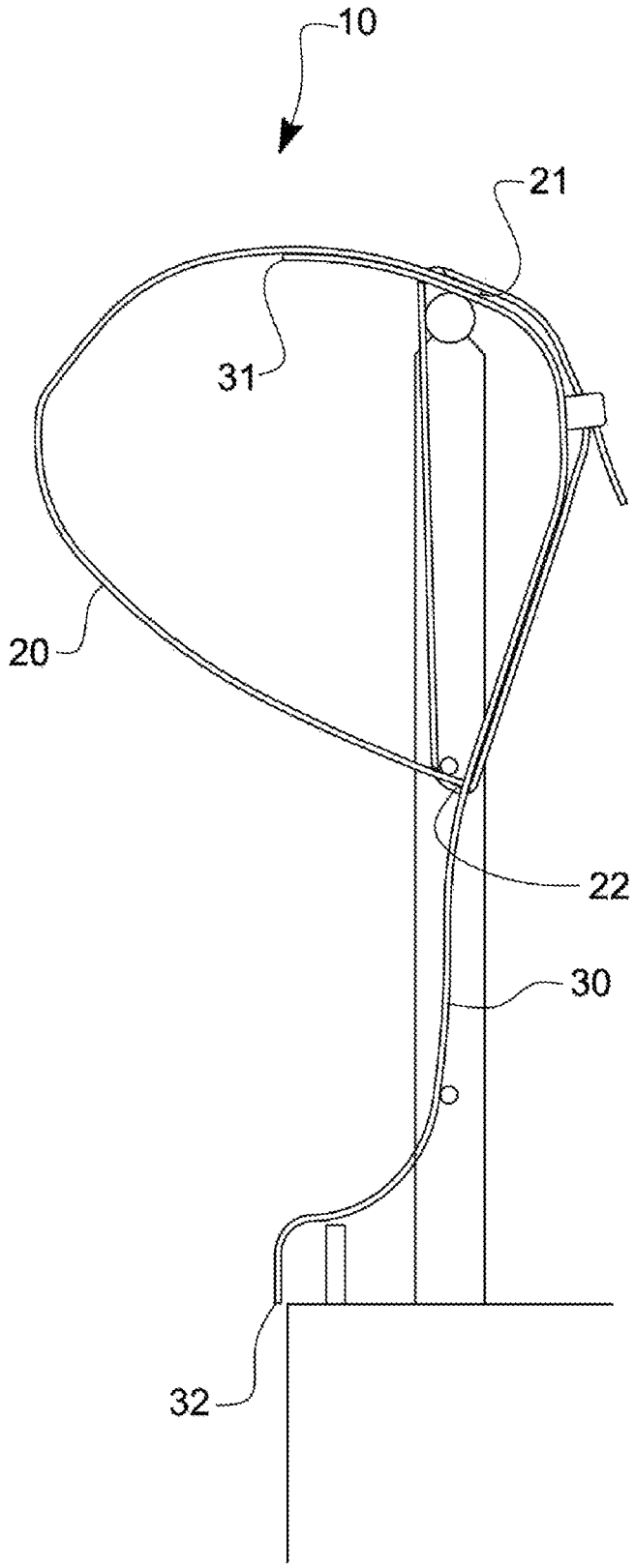
FIG. 5 illustrates a cross-sectional view of a security device in a second configuration.

FIGS. 3 to 5 illustrate the device 10 in the second configuration, attached to a railing.

When assembled in the second configuration, the upper face of the device comprises a portion of the barrier. The upper face extends in an approximately horizontal direction from the rail, or may slope slightly downwards. The barrier extends a certain distance from the rail. The barrier then curves downwards and back towards the rail. Where the lower edge of the barrier meets the panel, it may be at an angle of approximately 90° (i.e. generally horizontal), or more preferably may be at a shallower angle with respect to the panel. The general shape of the barrier is that it extends outwardly from the rail at its upper end (preferably in a generally horizontal direction), describes a bulbous shape and then returns towards the rail to meet and be secured to the panel. Any load that is applied to the barrier (such as a generally downward force arising from the weight of a person attempting to climb over the barrier) will be transferred into the panel along the lower edge of the barrier.

As mentioned above, the barrier and panel are provided with one or more slots for receiving straps or webbing 41. These are positioned such that the panel and barrier may be secured to each other.

The panel has a first series of slots located at or near its mid-point, proximal to where the lower edge of the barrier makes contact or near contact. The panel has a second series of slots located a short distance below the upper edge of the panel. The second series of slots are located a distance below the upper edge of the panel which corresponds to the desired overlap distance between the panel and the barrier. Further, there is correspondence between the first series of slots and the second series of slots across the width of the panel. Typically the slots will be spaced around 0.5 m apart. Typically a series of slots will comprises three slots, located one at the centre of the panel and one proximal to each of the edges. The number of slots will vary with the width of the panel.

The barrier has two series of slots also. These are located proximal to the lower and upper edges of the barrier. Across the width of the barrier, the position of the slots corresponds with the position of the slots located on the panel.

Thus, in order to secure the device in the second, assembled configuration, straps or webbing 41 may pass from the inboard side of the panel, through the mid-point slot of the panel, in an upward direction through the lower edge slot of the barrier, through the upper edge slot of the panel and finally through the upper edge slot of the barrier. The ends of the straps or webbing 41 are then secured to each other. For example, a first end may be fixed to a locking ratchet mechanism 42, and the second end of the strap 41 may pass through the ratchet mechanism 42 in order to be secured and hold the device in shape. In the assembled configuration, the ratchet mechanism 42 is preferably position on the inboard rear side of the device.

When in the second or assembled configuration, the upper overlapping portion of the barrier is preferably on top of the upper overlapping portion of the panel. Thus, the upper edge of the panel is on the inside of the bulbous shape of the barrier. By protruding into the bulbous cavity shape of the barrier, the upper portion of the panel assists in providing a suitable shape to the barrier, in particular to provide extension in the horizontal direction of the device when installed around a railing. For a device where the horizontal extent of the overhang beyond the plane of the railing is approximately 70 cm, the overlapping portion will be at least 35 cm. The necessary overlap to achieve the required overhang will depend on the material properties, and therefore may vary accordingly. The overlap may be more than the 50% of the horizontal dimension of the device, for example 60-70%. In some embodiments, the overlap between the panel and the barrier may be nearly or substantially equal to the horizontal limit of the device.

The device is intended to hold up to a load applied to the barrier. Typically this will be in the order of 100s to 1000s of Newtons, i.e. sufficient to support the weight of one or more people and portable equipment used in trying to traverse or climb over a railing.

As will be apparent from the foregoing, the assembled shapes of the panel and barrier will to an extent depend on the materials used for the components. As mentioned above, typically a plastic material will be used for both components. Alternatively, a fine metal mesh may be used such that the mesh is fine enough so that it is not possible to attach a hook. The materials should be relatively stiff to provide stability to the final shape but flexible enough such that the curved shapes may be achieved. It is envisaged that resilient plastics or flexible metal will be used so that when in the unassembled configuration the components of the device will return to their original shape and configuration. If the components have been in the assembled configuration for some time, they may take some time to 'relax' back to their original flat shape.

The barrier and panel may be made from 'off-the-roll' sheets of material. Fastening slots are machined through the sheet. Alternatively, other types of fastening points are incorporated into the sheet of material. The straps or webbing used to secure and shape the device may be 'off-the-shelf' with properties sufficient for the purpose and used with little or no modification.

Relative to each other, the panel material may be stiffer than the barrier material because the barrier must turn through tighter radii than the panel. Such relative properties may be achieved through using different materials or varying the thickness of the sheets used to form the barrier and panel.

For example, the panel may be high-density PE (HDPE), while the barrier is medium-density PE (MDPE).

Alternatively, a thinner sheet of material will be more flexible than a relatively thick sheet of material. However, the thinner sheet of material will have a lower relative strength. For example, flexible material may have a thickness of 4-6 mm and more rigid material, that requires a hinge, may have a thickness of 10 mm.

With the arrangement described, if a less strong material is used for the barrier, the overlap between the barrier and the panel will strengthen the barrier structure because of the panel material under the barrier material. Therefore, the overlap may be greater for a panel and barrier of 4 mm thickness than an embodiment using a stiffer and or thicker material. In some embodiments, the barrier structure may be further stiffened using a different strap configuration and reinforcing elements as will be described in more detail below.

It is also envisaged that the thickness of the sheet that forms the barrier and/or the panel may vary along its length. For instance, the thickness of the barrier may be reduced around its mid-section, where the barrier must curve through the tightest angle in order to form the bulbous overhanging shape.

Accordingly, the cost of manufacturing the components of the device is relatively low, and typically the materials will be readily available.

As noted above, the device may have a set of three slots or fastening points in each series to be used with three straps to secure the device to a railing. The device will usually be secured from the inboard side of the railing. Each strap is threaded through the respective slots in order. The straps are then tightened in order to pull the device, and in particular the barrier, into shape. A ratchet may assist with tightening the straps. Once the device has assumed the required shape in the second configuration the straps are secured. In one arrangement the centre strap is stronger than the straps used through the slots adjacent to the edges of the device. In this case, the central strap is primarily used to pull the device into shape while the primary function of the edge straps is to secure the device to the railing.

Accordingly, a security device that may be attached to a railing is provided. The security device has a bulbous outboard side that provides a relatively featureless surface and an overhang, making it difficult to climb over on the outboard side. The security device may be readily assembled and secured onto the railing from the inboard side.

Figure 19:
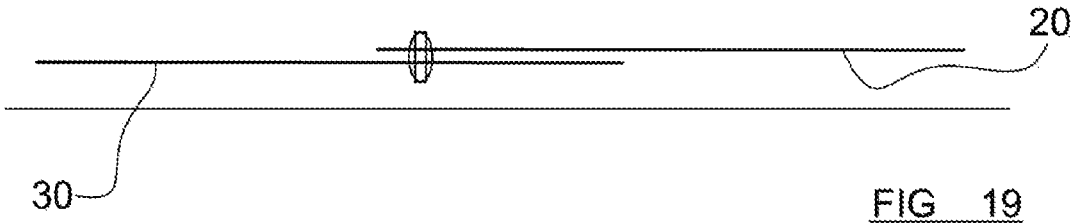
FIG. 19 illustrates a first step of installing a security device.

For example, as shown in FIG. 19 and starting from a first configuration or storage arrangement, the barrier 20 and the panel 30 are placed in an overlapping arrangement and secured to each other using a fastener, such as a tie, and a flexible installation member rope or cable 8 is attached to a free end of the barrier 20. The device may, at this stage, lie on and/or be substantially parallel with the surface of a ship's deck.

Figure 20:
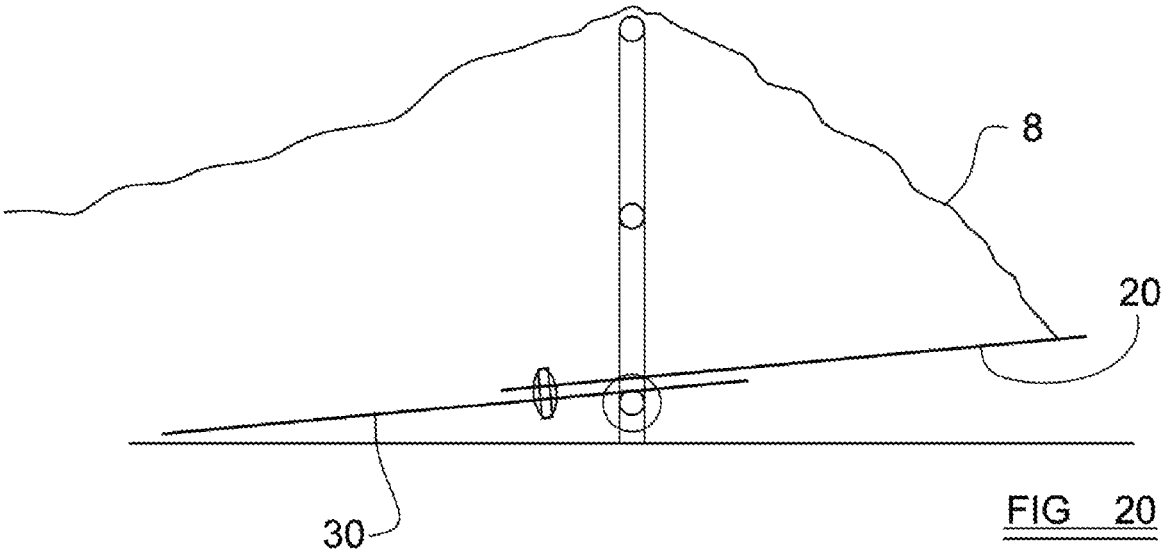
FIG. 20 illustrates a second step of installing a security device.

As shown in FIG. 20, the device is threaded through the railing, leading with the barrier 20, and above the lowest rail. Accordingly, the lower end of the panel 30 and the upper end of the barrier 20 are outboard relative to the railing, and the lower end of the barrier 20 and the upper end of the panel 30 are inboard relative to the railing. The free end of the rope 8 is passed over and held over the uppermost rail.

Figure 21:
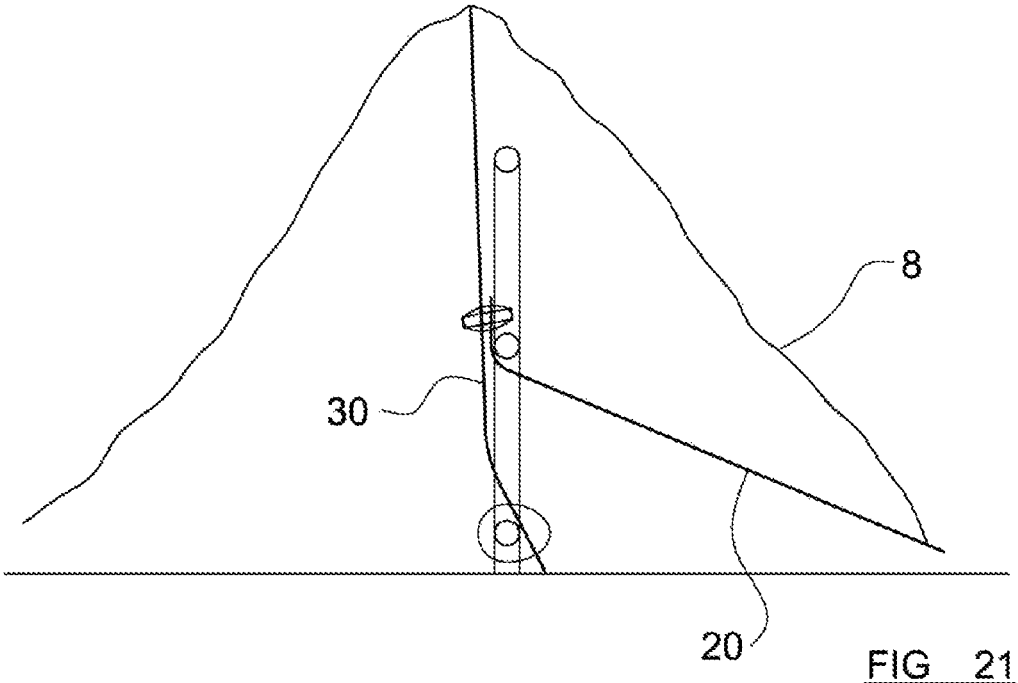
FIG. 21 illustrates a third step of installing a security device.

As shown in FIG. 21, while holding the free end of the rope 8 on the inboard side of the rail, the device is rotated until the panel 30 is substantially vertical. The lower end of the panel 30 is positioned on the outside of the rail and the upper end of the panel 30 extends above the upper rail and on the inside of the rail. Further, the securement between the panel 30 and the barrier 20 is located proximate to a middle rail.

Figure 22:
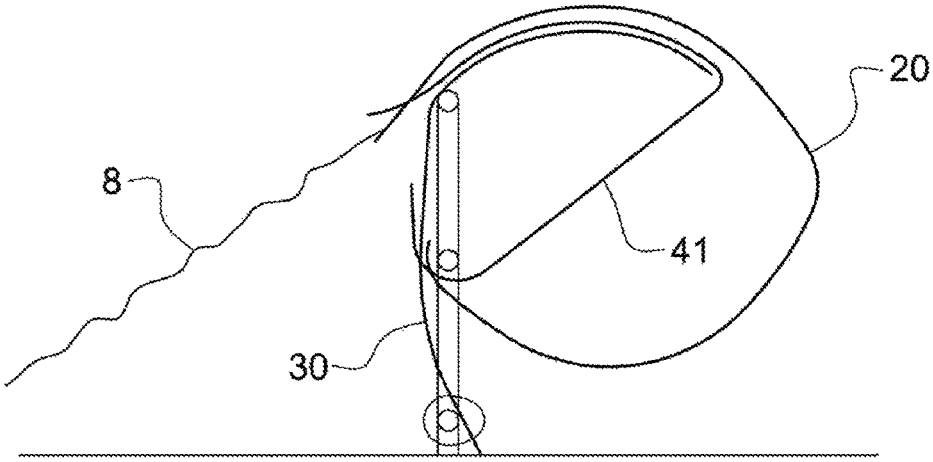
FIG. 22 illustrates a fourth step of installing a security device.

Subsequently, as shown in FIG. 22, tension is applied to the rope 8 to bend the barrier 20 over the top of the panel 30 and into a bulbous shape. The panel 30 is bent towards the outboard direction relative to the rail, and the barrier 20 is bent over the panel 30 towards the inboard direction. Subsequently the barrier 20 is bent downwards to be substantially parallel with the vertical section panel. The overlapping portions of the panel 30 and barrier 20 are substantially parallel, with the panel 30 inside of the bulbous shape formed by the barrier 20.

Figure 23:
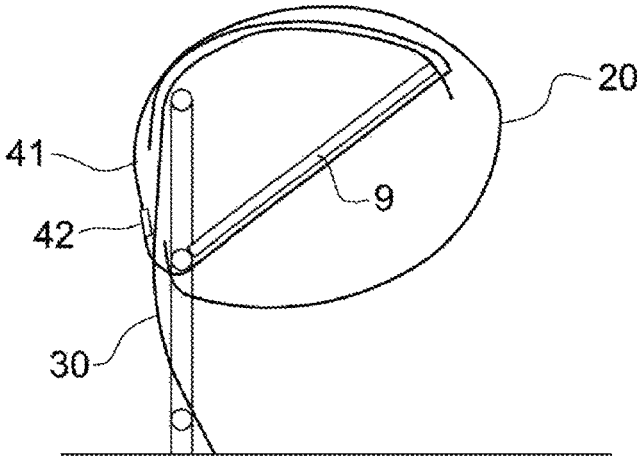
FIG. 23 illustrates a fifth step of installing a security device.
Figure 24:
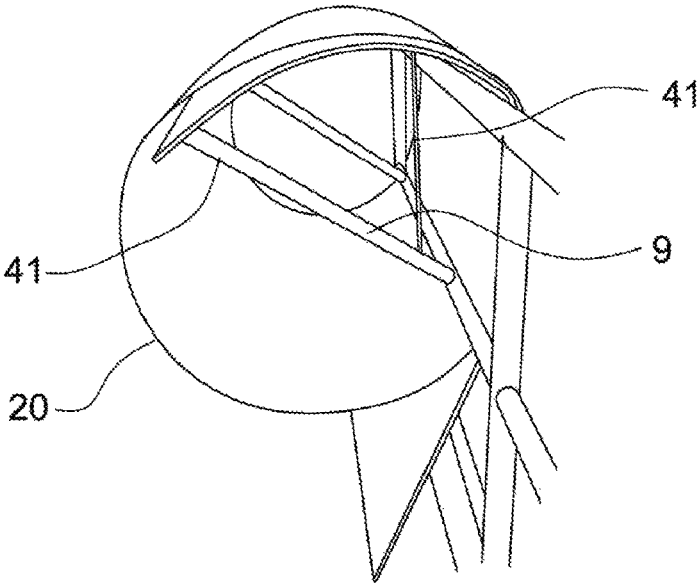
FIG. 24 illustrates a security device in a second configuration and using a pole.

Finally, as shown in FIGS. 23 and 24 the barrier 20 and the panel 30 are secured to each other and around the railing using a fastening such as those which have been described herein. The device is then in the second configuration. The rope or cable 8 can then be removed and used for installing other devices adjacent to the first device or in other areas which may need protection.

In the example shown in FIGS. 23 and 24 the shape of the barrier 20 is reinforced with a pole 9 which is positioned inside the barrier 20 and braced between, at one end, a rail (in this case, the middle rail) and, at the other end, the inner surface of the upper end 31 of the panel 30. The strap 41 extends around the pole 9, end-to-end, and is secured on the inboard side of the device with a ratchet 42 or another suitable fastener.

Various modifications, additions and alternatives are described below. As far as they are compatible, the modifications, additions and alternatives may be used interchangeably or together.

In one arrangement, the barrier may be modified so that it preferentially bends at one or more particular points to provide a specific shape. For example, the sheet may be modified to include one or more 'living hinges'.

Figure 6:
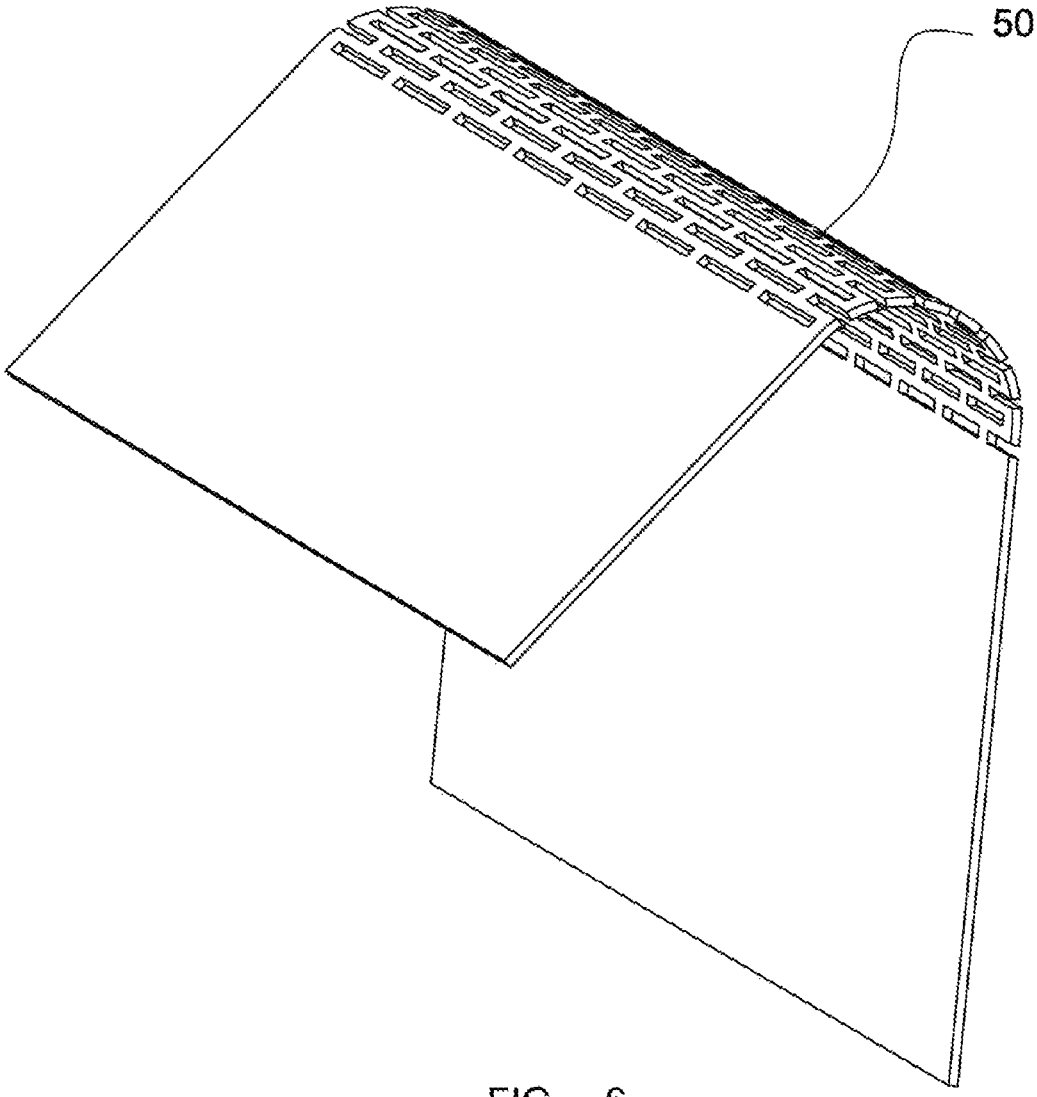
FIG. 6 illustrates an example of a living hinge.

An illustration of 'living hinges' is provided in FIG. 6. This is an illustration only showing how a relatively rigid material can be formed into a folded or bent shape along certain lines. Across the width of the material, certain sections of material are cut out leaving behind a mesh of material 50. The mesh of material is more easily able to flex to allow the sheet to bend and deflect. Thus, the material may be repeatedly bent along the living hinge without overstressing the material and minimising fatigue of the material. Different mesh designs may achieve flexibility in different directions. Thus, a sheet of material may be designed to bend preferentially at particular locations and in a particular direction. The skilled reader will understand how using one or more hinges of this type may result in a sheet which is be designed to bend readily into a particular shape.

An alternative arrangement for a living hinge as described above may be formed in a component by varying the thickness of a sheet material. A section of the sheet, across the width of the sheet, may be thinner than the rest of the sheet. Thus, the sheet will preferably bend along the thinner section. In another alternative arrangement, the material may have a corrugated profile. In another alternative, or in addition to the living hinges already described, the material may be reinforced with ribs across the width of the material.

In an alternative arrangement, the barrier shape may be achieved using a frame and shell structure. For example, a skeleton frame such as a hoop would be attached to the panel at each of the side edges of the panel. Additional skeletal structure would be provided as necessary, for example bracing cross-bars for additional support. A flexible shell would be attached at the mid-point of the panel, where the barrier meets the panel at the lower edge of the barrier, and extend over the frame and over the top of the upper portion of the panel. In this arrangement, the frame structure could be made of a more rigid material, such as metal hoops or tubes. The shell could be made of a relatively weak and more flexible plastic material. If the shell material is flexible enough, the shell would be attached to the panel on the inboard side of the panel. Otherwise the shell would be attached to the upward facing upper portion of the panel. The skilled person would understand that any suitable fastening arrangements could be used to attach the frame and shell to the panel to replace the slot and strap arrangement or in addition to the slot and strap arrangement.

As mentioned above, the shape of the barrier 20 may be reinforced with a pole 9 inside of the barrier 20. Such an arrangement is illustrated in FIG. 24. Two poles 9 are located between the upper end of the panel and a middle railing. The poles 9 are located at or near respective sides of the device. The poles 9 are secured in position with straps 41. The straps 41 extend from the inboard side of the rail through the panel 30 and the barrier 20 at the middle rail, along the length of the pole 9 on the underside of the pole 9 to ensure that the pole is maintained in position, over the upper end 31 of the panel 30 so that the strap 41 is between the panel 20 and the barrier 30 and through the barrier back towards the inboard side of the rail. The ends of the strap 41 are then secured together and tightened, for example using a ratchet arrangement. Additionally, the device may be secured to the rail with a strap 41 that extends around the upper and middle rail as described herein.

Using a pole 9 to maintain the shape of the device has an advantage that a thinner and/or more flexible material may be used for the barrier 20 and the panel 30. Thus, the device will be easier to install, transitioning between a first configuration and a second configuration and without the need for bending tools. Further, the device will use less material and be lighter for transportation. In addition, if the barrier 20 were to be loaded from the outboard side it is less likely to deform. Therefore, the barrier 20 will maintain its shape and be difficult to climb over even under significant loading.

An alternative arrangement using an X-shaped cross frame arrangement may be used in place of pole 9. The alternative arrangement will be described in more detail below.

With any of the arrangements described above, in particular for a mesh living hinge, an additional wrapping or sheet may be used to cover any discontinuities of the outboard side of the device which may provide a point to attach a grappling hook.

In an alternative arrangement, the device could be made primarily from rigid materials.

In an embodiment, the panel is formed in a permanent shape for fitting through and over a railing. Here, "permanent" means that the panel will retain the same or substantially the same shape when in storage and also when in use, and is not intended to be repeatedly moved between a storage configuration and an "in use" configuration, where the shape of the panel is significantly different in these two configurations. The shape is similar to a question mark ('?'). The upper edge curves over the uppermost rail (with the free end facing in the outboard direction), the middle portion curves through the railings and the lower portion or tail extends to the deck and/or over the fish plate. In an unassembled configuration, it may be possible to stack several panels together.

Figure 7:
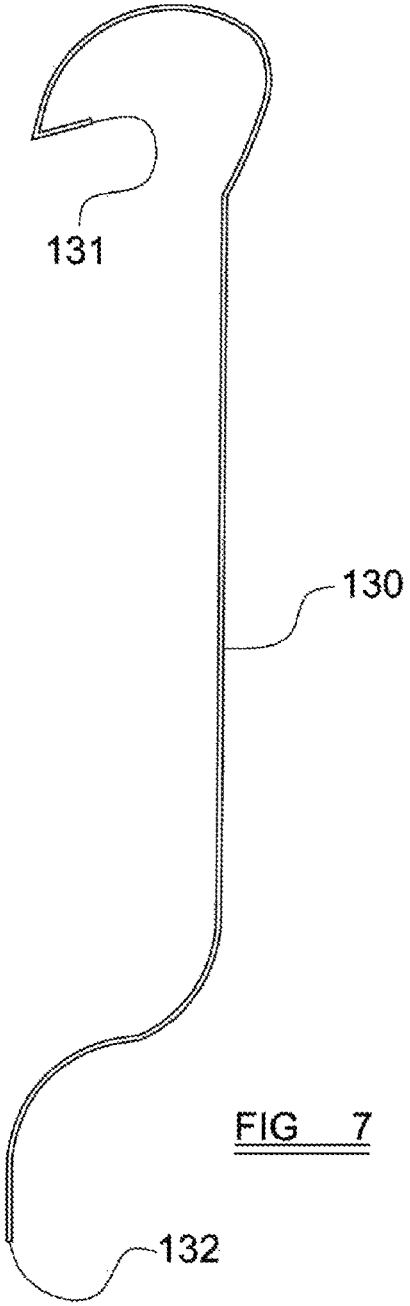
FIG. 7 illustrates a rigid material panel in a first configuration.

A rigid panel 130 is illustrated in FIG. 7. The rigid panel 130 has an upper edge 131 and a lower edge 132.

A rigid formed panel could be used together with a flexible barrier or a rigid formed barrier, with hinges as described below.

A rigid barrier is formed with one or more hinges such that the barrier may be bent along the hinges to form a shape that provides an overhang. In embodiments, the barrier may form a generally horizontally-pointing triangular cross-section overhang. Hinges proximal to the ends of the barrier create tabs at the ends of the barrier sheet which may be used for attaching the barrier to the panel with bolts and nuts or another suitable fastening arrangement. A further hinge is provided approximately across the middle of the barrier sheet, enabling the sheet to be folded into the triangular cross-section. Thus, in a first configuration the barrier is substantially flat or planar. In a second configuration the barrier, when attached to a suitable panel, has a substantially triangular shape. Accordingly, the barrier may readily be transitioned between the first configuration and the second configuration by bending the barrier about the hinges. In the first configuration the barrier may be 'flat packed'.

Figure 8:
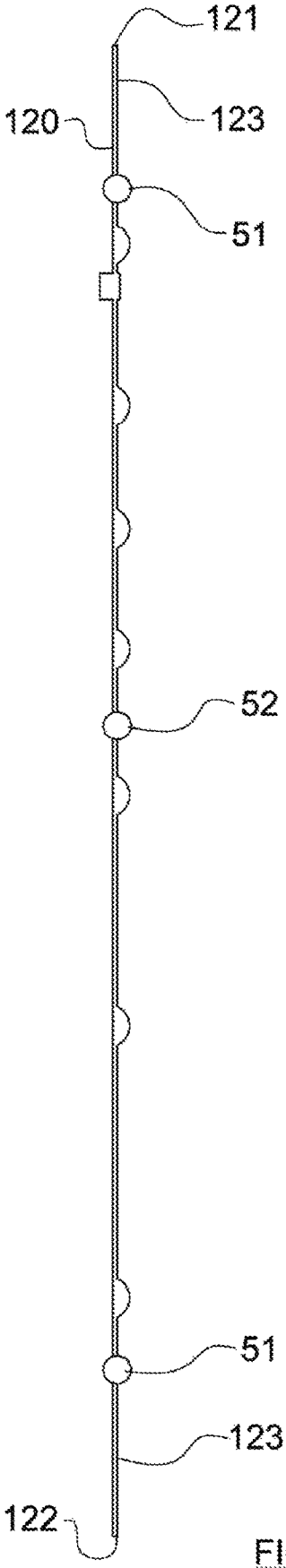
FIG. 8 illustrates a rigid material barrier in a first configuration.

FIG. 8 illustrates a rigid barrier 120 in a first configuration. The barrier 120 has an upper edge 121 and a lower edge 122. The barrier 120 includes first hinges 51 proximal to each of the first and second edges 121, 122 thereof. The barrier 120 also includes a second hinge 52, provided at or near the midpoint thereof. In the first configuration shown in FIG. 8, the entire barrier 120 is substantially planar, and is not deflected or bent at any of the hinges 51, 52.

Figure 9:
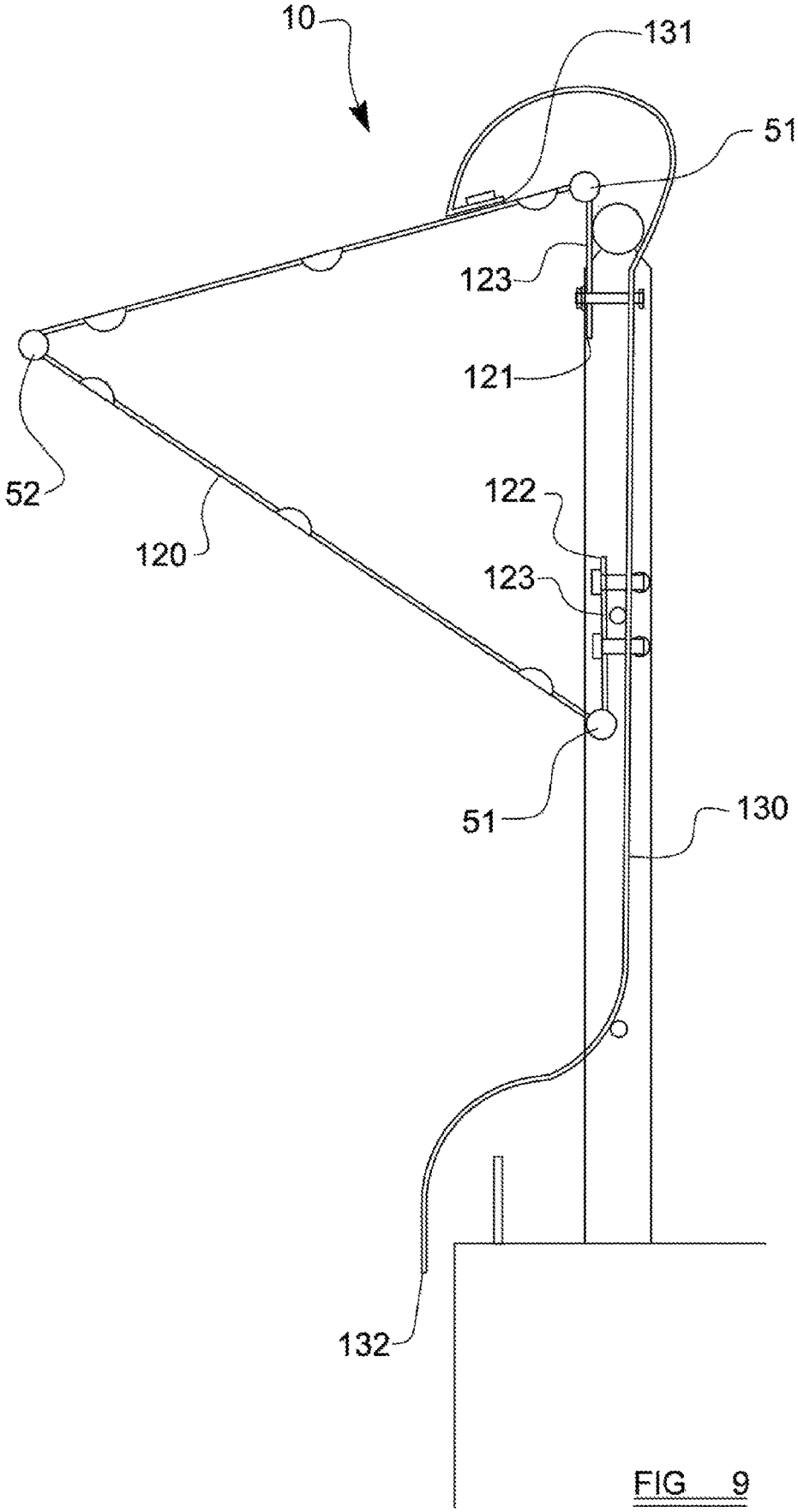
FIG. 9 illustrates a security device in a second configuration.

FIG. 9 illustrates the rigid barrier 120 of FIG. 8 and the rigid panel 130 of FIG. 7 in a second configuration, assembled around a railing. First hinges 51 proximal to each of the first and second edges 121, 122 of the barrier 120 allow the barrier 120 to be folded for attaching to the panel 130. As shown in FIG. 9, the length of the barrier 120 between each of the first hinges 51 and the upper and lower edges 121, 122, respectively, forms a relatively short tab 123. In the embodiment shown, both of the tabs 123 are arranged to be vertical or substantially vertical in the second configuration, and the tabs 123 are attached to the panel 130. In preferred embodiments, each tab is provided on the outboard side of the railing, and the panel 130 is provided on the inboard side of the railing. Bolts are passed through the tabs 123 and the panel 130 and are tightened to draw the tabs and the panel 130 together, with a rail of the railing being sandwiched tightly between each tab and the panel 130.

Second hinge 52 allows the barrier 120 to be folded to a triangular cross section, to form an overhang which protrudes horizontally outwardly from the plane of the railing.

Figure 10:
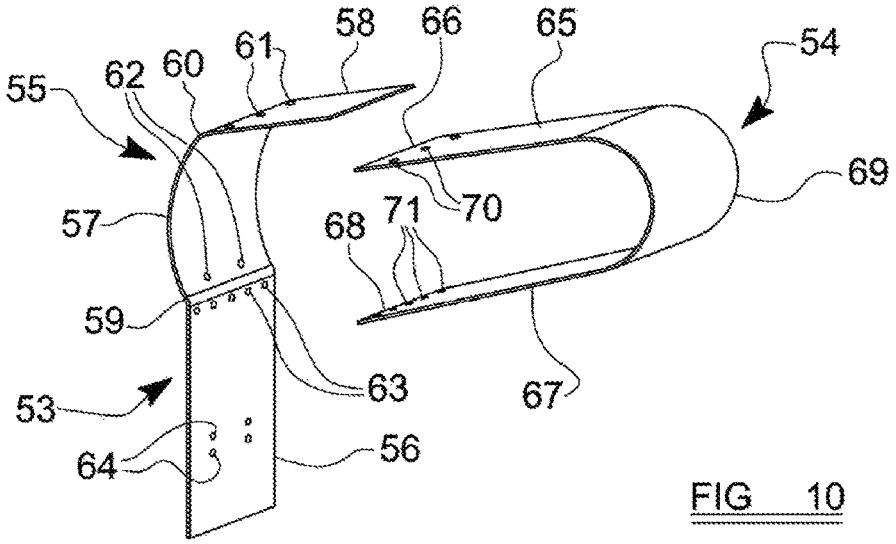
FIG. 10 illustrates a security device in an unassembled arrangement.

With reference to FIG. 10, the components of a further device 55 are shown. The further device 55 comprises a panel 53 and a barrier 54, as with the above examples.

FIG. 10 shows the panel 53 and barrier 54 separated from one another, for the purposes of clarity.

The panel 53 has a lower section 56, comprising around half of the total length of the panel 53, and which is substantially planar. An intermediate section 57, adjacent the lower section 56, is curved in cross-section to define a bulge in a direction which will (when the device 55 is assembled and installed) be the inboard direction.

Finally, the panel 53 has a top section 58, which is attached to the upper end of the intermediate section 57, the top section 58 once again being generally planar.

In the arrangements shown in FIG. 10, the upper section 58 is arranged to be generally at right angles to the lower section 56. This is the arrangement of the various parts 56, 57, 58 of the panel 53 ready for installation on a railing (not shown). The panel 53 may be permanently formed in this configuration. Alternatively, the connection 59 between the lower section 56 and the intermediate section 57, and for the connection 60 between the intermediate section 57 and the upper section 58, may be flexible (using, for example, living hinges, discussed above) to allow the panel to be laid substantially flat.

A number of connection holes or slots are formed in the panel 53.

A series (in the example shown, three) of slots 61 are formed through the upper section 58, near the junction 60 with the intermediate section 57.

Further connection slots 62 are formed on the intermediate section 57, near its junction 59 with the lower section 56. In the embodiment shown, there are two of these connections slots 62.

On the lower section 56, a series of connection slots 63 (in the embodiment shown, there are 5 such slots) are formed near the junction 59 with the intermediate section 57.

Finally, two pairs of spaced apart connection slots 64 are formed approximately midway down the length of the lower section 56.

The barrier 54 again takes the form of a generally rectangular strip of material. In this embodiment, the barrier 54 comprises a first section 65, which extends from a first end 66 of the barrier 54 and extends over approximately a third of the length of the barrier 54.

A second section 67 extends from a second end 68 of the barrier 54, and again extends for roughly a third of a total length of the barrier 54. Between the first and second section 65, 67 is a transition section 69. The transition section 69 is formed to be more flexible than the first or second sections 65, 67. FIG. 10 shows the barrier 54 configured ready to be installed as part of a finished device. The first and second sections 65, 67 are generally flat and planar, and the transition section 69 is curved smoothly through approximately 180°, or slightly less than 180°. It will therefore be understood that the barrier 54 generally forms a "U"-shape.

Near the first end 66, the first section 65 has a series (in this case, three) connection slots 70. Near the second end 68, the second section 67 has a series (in this example five) connection slots 71 formed therethrough.

Figure 11:
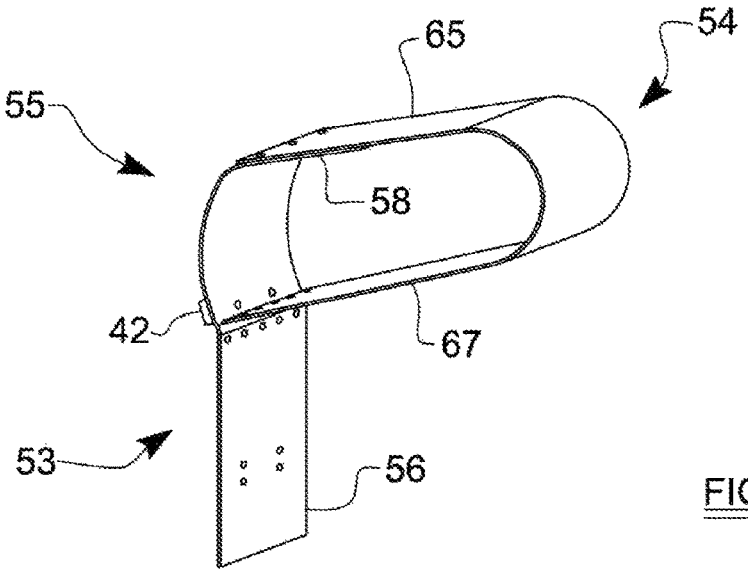
FIG. 11 illustrates a security device in an assembled arrangement.

In order to assemble the device 55, the first section 65 of the barrier 54 is placed over the top surface of the upper section 58 of the panel 53, so that the respective connection slots 61, 66 formed in these sections 58, 65 align with one another. The second end 68 of the barrier 54 is placed against, or near to, the junction 59 between the lower and intermediate sections 56, 57 of the panel 53. The resulting arrangement is shown in FIG. 11.

Figure 12:
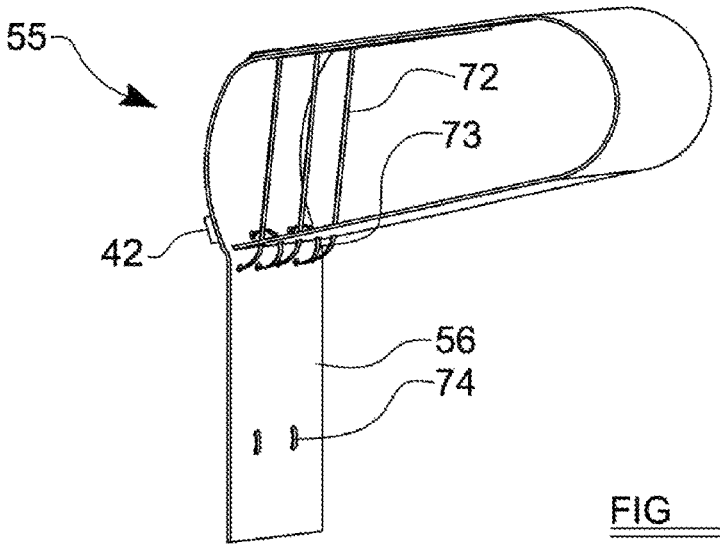
FIG. 12 illustrates a security device in an assembled arrangement.

The device 55 is then secured in this position, and also secured to the rail, by means of attachment straps or the like. An example of the device 55 when assembled in this way is shown in FIG. 12. A first series of connection straps 72 (in the example shown, there are 3 such straps 72) pass from the inboard side of the panel 53, through some of the connection slots 63 formed at the upper end of the lower section 56 of the panel 53, upwardly through some of the connection slots 71 formed near the second end 68 of the second section 67 of the barrier 54, upwardly through the connection slots 66, 61 formed in the first section 65 of the barrier 54 and the upper section 58 of the panel 53, respectively, and then over the exterior rear surface of the intermediate portion 57 of the panel 53 to complete a closed loop. As discussed above, the straps may be provided with two free ends which are joined to one another and tightened using a ratchet mechanism 42.

An upper rail of the railing preferably lies at or near the interior top side of the intermediate portions 57, of the panel 53, within the underside of the upper section 58 of the panel 53, so the device 55 is supported by the rail.

Separately, further connection straps 73 (in the example shown, two such straps 73 are provided) pass from the inboard side of the panel 53, through others of the connection slots 63 formed at the upper end of the lower section 56 of the panel 53, upwardly through others of the connection slots 71 formed near the second end 68 of the barrier 54, and then back through the connection slots 62 formed in the intermediate section 57 of the panel 53, so the straps 73 are once again on the inboard side of the panel 53 to form a closed loop. Preferably, a rail of the railing (likely to be an intermediate rail) is also enclosed within the loops formed by these further connection straps 73. The rail ideally lies just above the upper surface of the second section 67 of the barrier, so that it is within the barrier side and not accessible from the exterior.

Finally, a pair of short, looped straps 74 passes through the connection holes 64 formed part way along the lower section 56 of the panel 53, to secure the lower section 56 to a rail (likely to be the lower most rail) of the railing.

Figure 13:
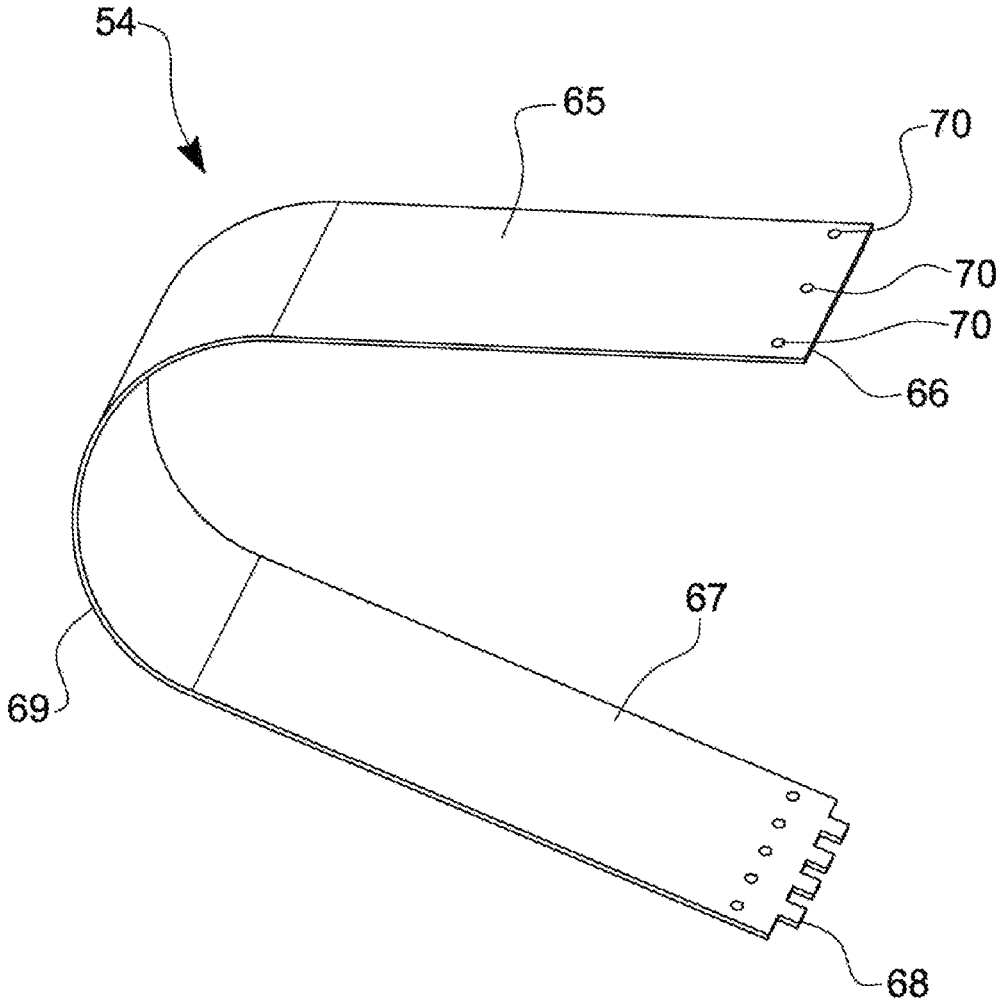
FIG. 13 illustrates a barrier for a security device.
Figure 14:
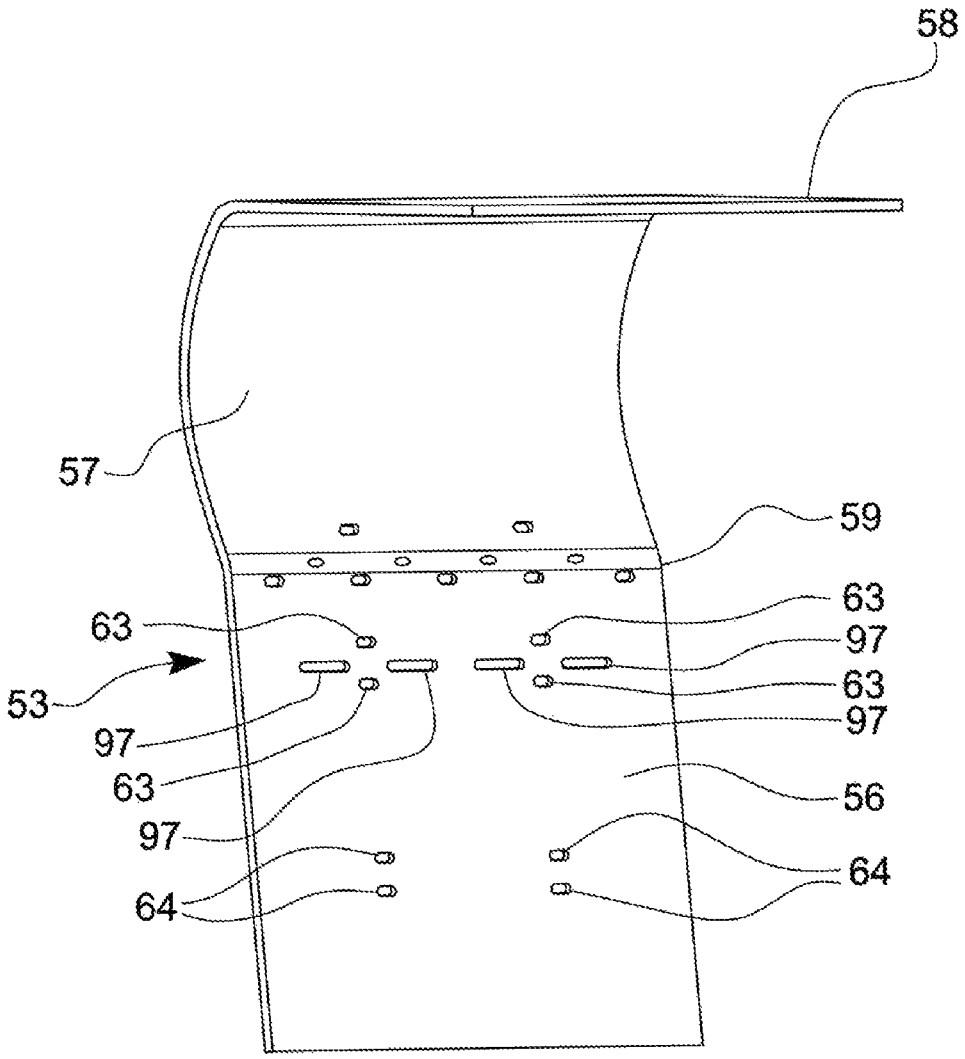
FIG. 14 illustrates a panel for a security device.

As a variant of this design, it is envisaged that the second end 68 of the barrier 54 may be formed with a series of protruding tabs, which preferably lie in the plane of the second section 67 of the barrier 54. The second end 68 of the barrier 54 may therefore have a castellated form. This variant is illustrated in FIGS. 13 to 15.

A corresponding number of registration slots 97 may be formed in the barrier 53, at or near the junction 59 between the lower section 56 and the intermediate section 57 thereof.

In use, where the second end 68 of the barrier 54 contacts the panel 53, the tabs or castellations fit into the slots 97, thereby securely registering the second end 68 of the barrier 54 in place with respect of the panel 53.

Figure 15:
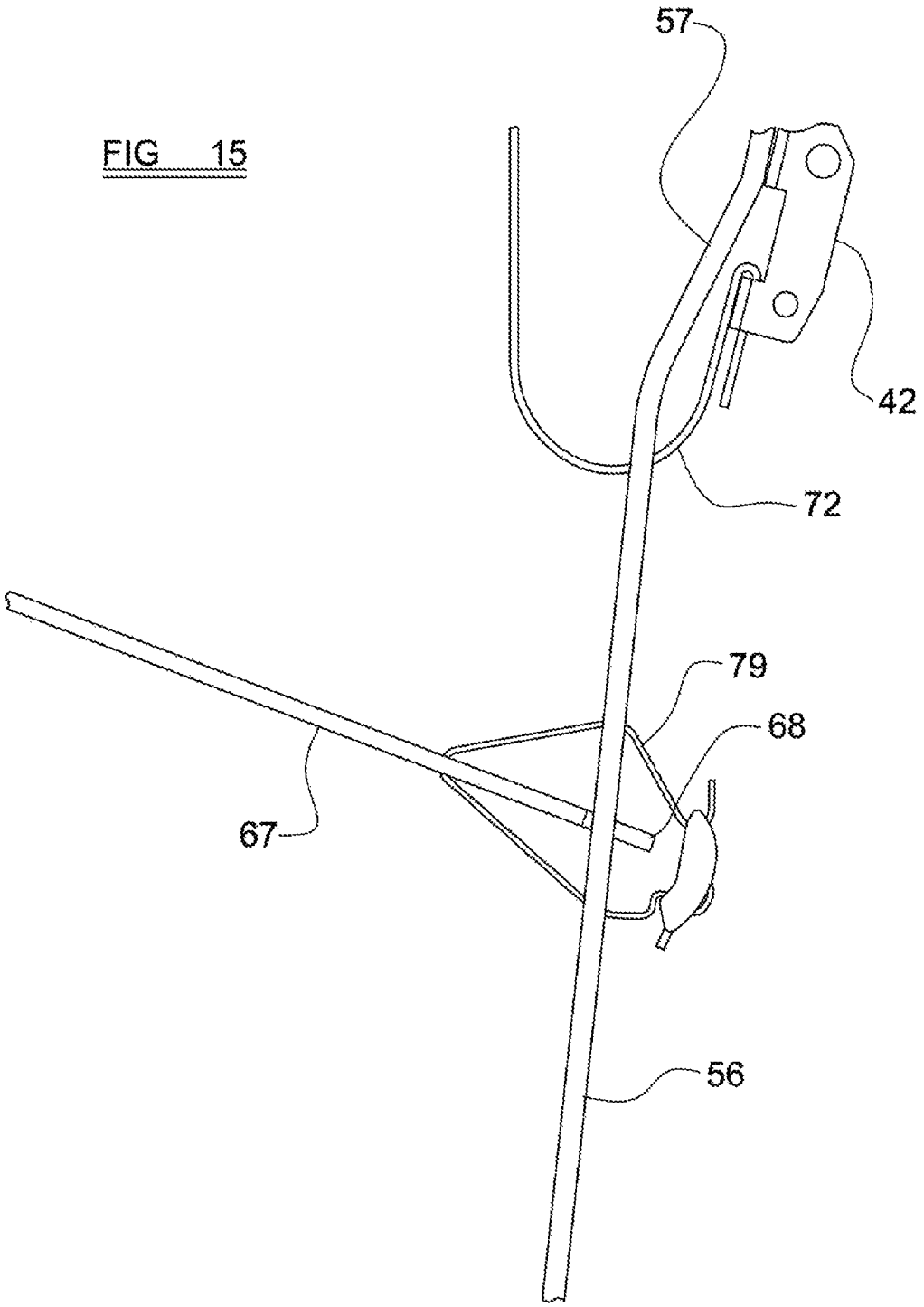
FIG. 15 illustrates a cross-sectional view of a portion of an assembled security device.

The registration slots 97 may be formed through the entire depth of the panel 53, so that the tabs pass all of the way through the slots 97 and protrude on the rear (i.e. inboard) side of the panel 53, as shown in FIG. 15. Alternatively, the registration slots 97 may be formed only part of the way through the depth of the panel 53, so that the tabs fit securely into the registration slots 97 and are prevented from moving laterally/vertically with respect to the slots 97, but do not pass all of the way through the barrier 53.

It is envisaged that the provision of tabs or castellations, in conjunction with correspondingly positioned and dimension registration slots 97, may assist greatly in maintaining the assembled configuration of the device 55, particularly when exposed to external forces such as inclement weather or the activity of unwelcome boarders.

In particular where significant downward forces are applied to the barrier, it is envisaged that significant mechanical strain will be placed on the junction between the second end 68 of the barrier 54 and the panel 53. Providing the tabs or castellations with corresponding registration slots 97 will assist with this. In addition, or as an alternative, the device 55 may be installed with respect to the railing such that the second end 68 of the barrier 54 rests on, or is positioned slightly above, one of the rails of the railing. If this is done, the strength of the railing itself will assist in maintaining the correct configuration of the device 55.

It is also envisaged that the mechanical stress at this junction will be reduced if the angle of the second portion 67 of the barrier 54 is arranged to be at a greater angle with respect to the horizontal. In preferred embodiments, the angle of the second portion 67 of the barrier 54 is at least 20° with respect to the horizontal (which may be taken to be perpendicular to the plane of the railing). In yet further preferred embodiments, the angle is at least 30°.

Figure 16:
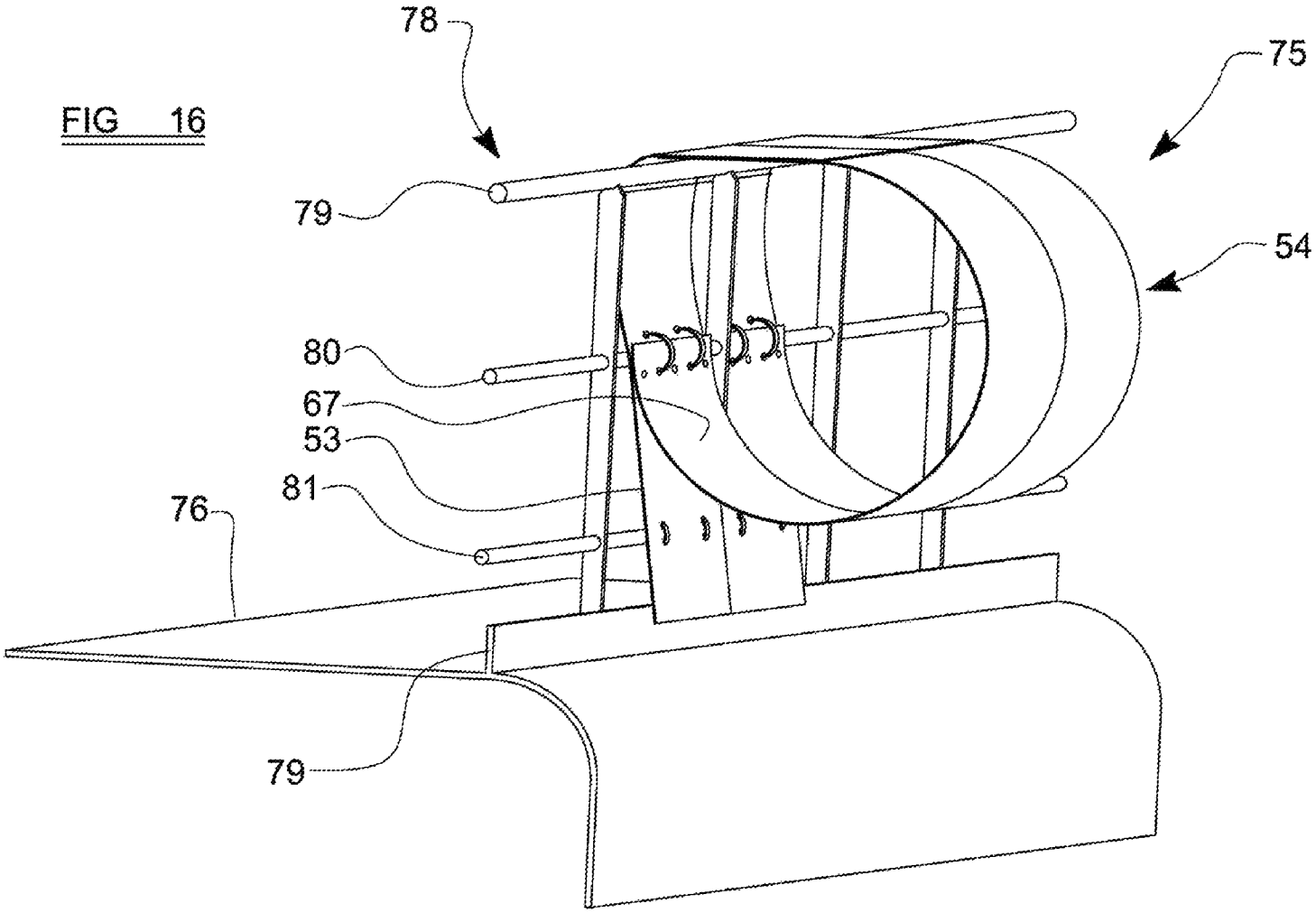
FIG. 16 illustrates an installed security device.

Turning to FIG. 16, a further device 75 is shown, installed on the deck 76 of a ship. As explained above in relation to other embodiments, the deck 76 includes an upstanding fish plate 77, and a railing 78 including a top rail 79, and intermediate rail 80 and a bottom rail 81.

The overall construction of the further device 75 is broadly similar to the device 55 shown in FIGS. 10 to 12. However, a key difference with this embodiment is that the second end 68 of the second portion 67 of the barrier 54 is curved so that, where it meets the inner (i.e. outboard) side of the panel 53, the second end 68 of the barrier 54 forms a relatively shallow angle with the panel 53 at that point, or lies substantially parallel therewith, and faces generally upwardly. Preferably, the angle formed between the panel 53 and the second end 68 of the barrier 53 is around 20° or less.

This configuration confers two advantages with respect to the device shown in FIGS. 10-12.

Firstly, the fact that the second end 68 of the barrier 54 lies flat, or substantially flat against the inner side of the panel 53 allows a strong and reliable connection to be formed between these two components. While connection straps are shown in FIG. 13, it will be relatively easy to use bolts or similar fastenings to connect the second end 68 of the barrier 54 to the panel 53.

Secondly, it is expected that this arrangement will be more robust when the barrier 54 is subject to significant external forces, such as downward forces arising from the weight of a potential boarder. This is because the forces acting at the junction between the second end 68 of the barrier 54 and the panel 53 will be transferred effectively to the panel 53. The barrier 54 is therefore less likely to collapse under the influence of external forces.

In all of the embodiments described above, the devices are formed from two main separate and separable components, namely the panel and the barrier.

It is also envisaged, however, that embodiments of the invention may be formed using only a single sheet of material.

Figure 17:
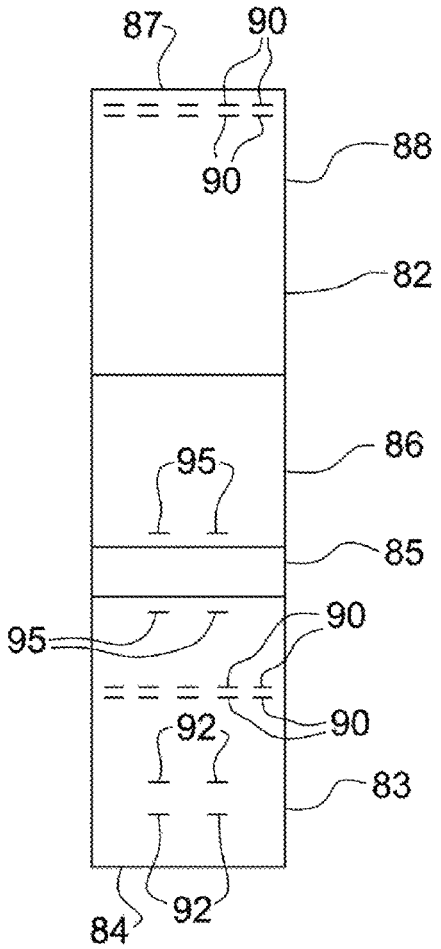
FIG. 17 illustrates a security device in a first configuration.

An example of this is shown in FIG. 17, which shows a single, generally rectangular sheet 82 of material (the total length of the sheet 82 may be around 2.5-3 m).

The sheet 82 has a first end 84, and a first region 83 extending from the first end 84 and comprising roughly a third of the total length of the sheet 82.

Adjacent the first region 83 is a second region 85, which is adapted to be relatively flexible, compared to the first region 83. The first region 85 may, for instance, include one or more living hinges, as discussed above.

Adjacent the second region 85 is a third region 86, which once again is adapted to be relatively inflexible. The length of the second region 86 is roughly a quarter of the total length of the sheet 82. Finally, extending between the third region 86 and a second end 87 of the sheet 82 is a fourth region 88, which is adapted to be relatively flexible.

Figure 18:
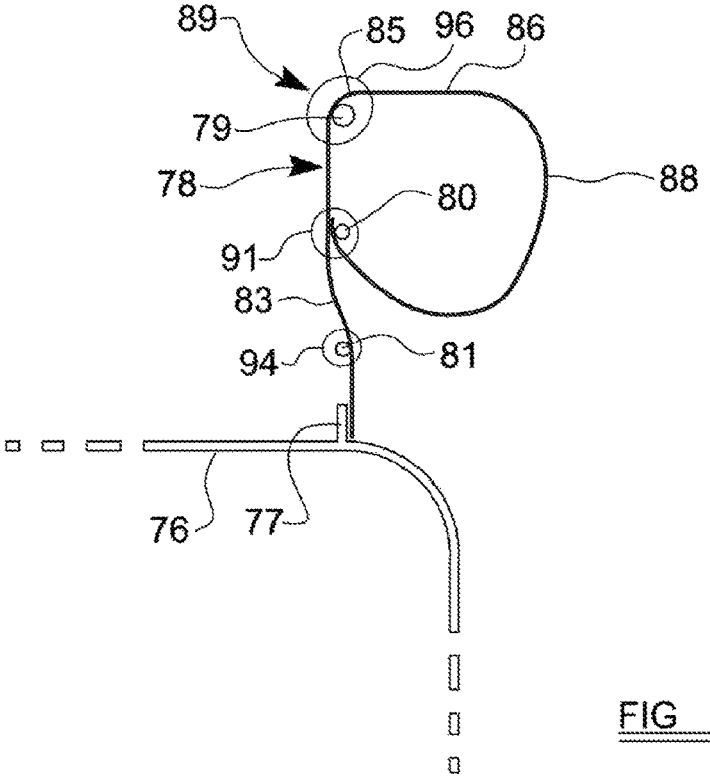
FIG. 18 illustrates a security device in a second configuration.

With reference to FIG. 18, the sheet 82 of material is shown installed as a security device 89. Once more, the device 89 is installed on the deck 76 of a ship, which includes an upstanding fish plate 77 and a railing 78 including a top rail 79, an intermediate rail 80 and a lower rail 81.

The first edge 84 rests on, or lies slightly above, the upper surface of the deck 76 of the ship, in front of (i.e. outboard of) the fish plate 77. The first section 83 extends upwardly, passing in front of the lower rail 81 and behind the intermediate rail 80, and terminates slightly below the top rail 79. The second region 85 then bends around the top surface of the top rail 79, and forms a transition region in which the angle of curvature of the device 89 is relatively high. The third section 86 of the sheet 82 of material then protrudes generally horizontally outwardly with respect to the plane of the railing 78. Finally, the fourth section 88 curves downwardly and describes a relatively continuous arc until it reaches, and lies against, the inner surface of the first section 83, either in front of or preferably (as shown in FIG. 18) behind the intermediate rail 80.

The sheet 82 of material includes co-operating connection slots 9 part-way along the length of the first section 83, and near the second end 87 thereof, to allow the second end 87 to be attached to the first section 83 where these components meet each other. A first connection strap 91 is shown in FIG. 15, passing through these connection slots 90, although it is envisaged that a connection using bolts or other fasteners may also be used at this point.

The sheet 82 of material also includes second connection slots 92 near the first end 84 thereof, to allow a pair (or any other suitable number) of second connection straps 94 to loop through these connection slots 92 and around the lower-most rail 81. Finally, third connection slots 95 are preferably provided on the first and third regions, close to where these regions meet the second region 85, to allow a third connection strap 96 to pass through these connection slots 95 and around the top rail 79.

It can therefore be seen that the single sheet 82 of material can move between a first configuration, shown in FIG. 17, in which the sheet 82 lies flat or substantially flat for storage or transportation purposes, and a second configuration, shown in FIG. 18, where the sheet 82 is bent into a device which includes a panel (formed primarily from the first section 83 thereof) and a barrier (formed primarily from the third and fourth sections 86, 88 thereof). It will be understood that this provides a solution that is very simple, since only one main component is needed, and there can be no confusion between separate panel and barrier pieces.

Except where the arrangements would be incompatible, it is envisaged that the technique of using a single sheet of material to form the barrier may be applied to any of the embodiments that are described above and which include two separate components. The skilled person will readily appreciate how this may be achieved. For instance, with regard to the embodiment shown in FIGS. 10 to 12, a single-piece device could be formed by the connection between the uppermost part 58 of the panel 53 being formed integrally with the first part 65 of the barrier 54.

FIGS. 25 to 37 show a step-by-step sequence for assembling a series of devices on a rail.

Figure 25:
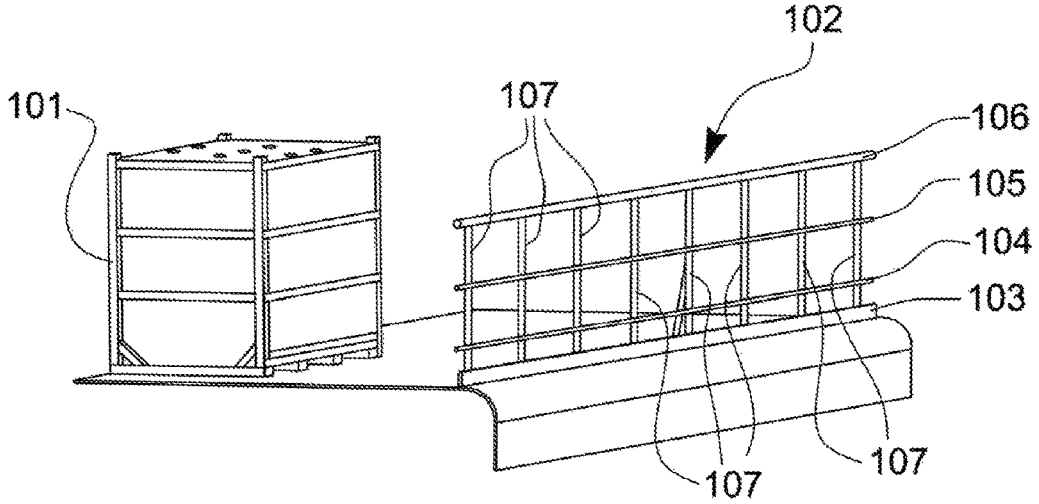
FIGS. 25 to 37 show a step-by-step sequence for assembling a series of devices on a rail.

Step 0 is shown in FIG. 25. The assembly process has not yet begun. The necessary components may be stacked in a box 101 near to the railing 102. The railing 102 has a kick plate 103 or fish board 103, a lower rail 104, a middle rail 105 and an upper rail 106. The rails 104, 105, 106 are supported by a number of stanchions 107.

Figure 26A:
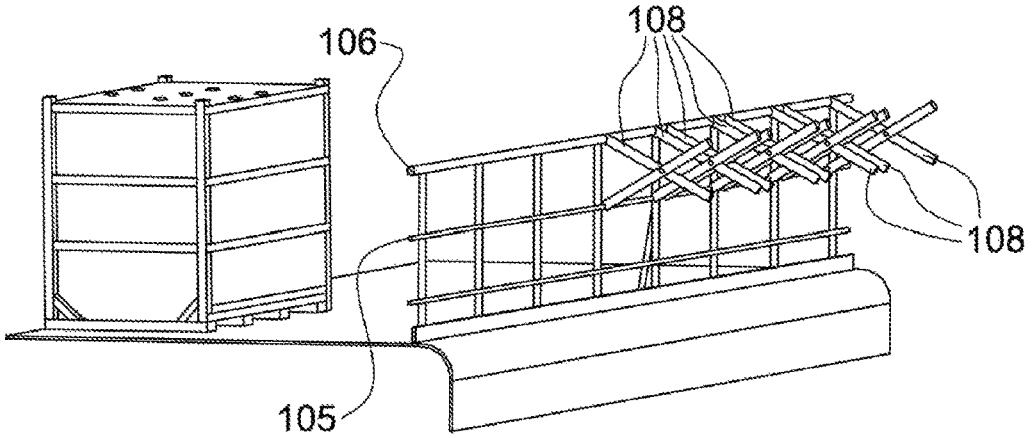
Figure 26B:
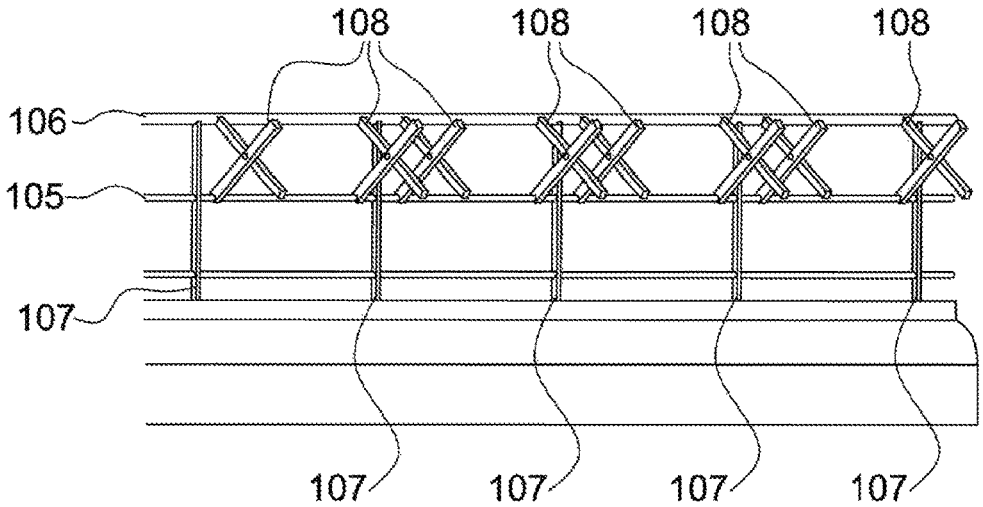

Step 1 is shown in FIGS. 26*a* and 26*b*, both figure show the arrangement from the outboard side. A number of scissor or X-shaped support bars 108 are positioned between the upper rail 106 and the middle rail 205. Preferably the support bars 108 are rigid and positioned proximal to, and each side of, a stanchion 107. The support bars 108 extend outboard from the railing 102. Free ends of the support bars 108 may be covered with rubber, or another high-friction material, to assist in maintaining their position. Also, the support bars 108 may have fastenings or attachments to keep them in place. Alternatively or in addition, the free ends of the support bars 108 may have a rough shape to neatly fit against the rail 102. The support bars 108 may be made from two bars attached at or around their respective mid-points, and able to pivot about the attachment point. Thus the support bars 108 may be in an open or closed position. In use, the support bars 108 will be in an open position. The closed position is more compact and may be used for storage.

Figure 27A:
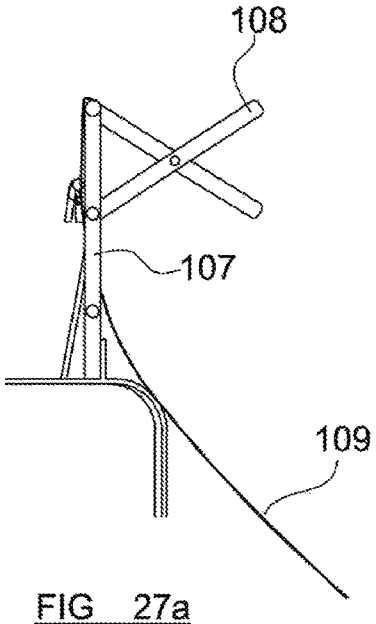
Figure 27B:
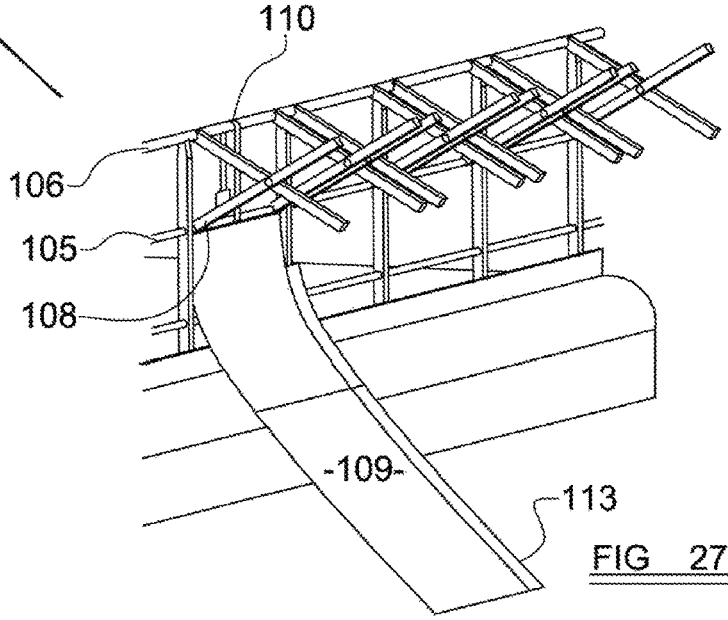
Figure 27C:
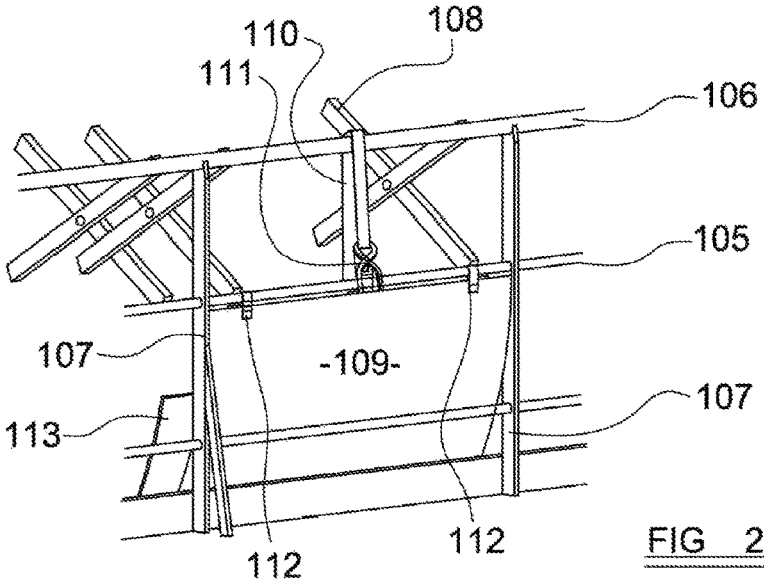

Step 2 is shown in FIGS. 27*a*, 27*b* and 27*c*. FIG. 27*a* shows the arrangement from one end, FIG. 27*b* shows the arrangement from the outboard side and FIG. 27*c* shows the arrangement from the inboard side. A first sheet of material 109 is attached to the middle rail 105 between two stanchions 107. The first sheet of material 109 has attachment slots (in preferred embodiments, three such slots) formed therethrough at the end proximal to the middle rail 105. The sheet of material 109 is secured with a strap 100 and ratchet 111 extending through the middle slot and around the upper rail 106 and the middle rail 105. Ties 112 are used through the outer slots, to secure the sheet 109 to the middle rail 105.

The first sheet of material 109 is substantially rectangular and has a width which substantially fills the gap between adjacent stanchions 107. The opposite end of the first sheet 109 extends in a downward direction on the outboard side of the rail 102. On one side of the first sheet 109, the width of the sheet 109 is extended to form a tab or what will be an overlap 113. The overlap 113 starts a short distance below the end with the slots for attaching the end to the middle rail 105 and extends to the opposite end of the sheet 109. The first sheet 109 will eventually become the outer surface of the barrier portion of a first device.

Figure 28A:
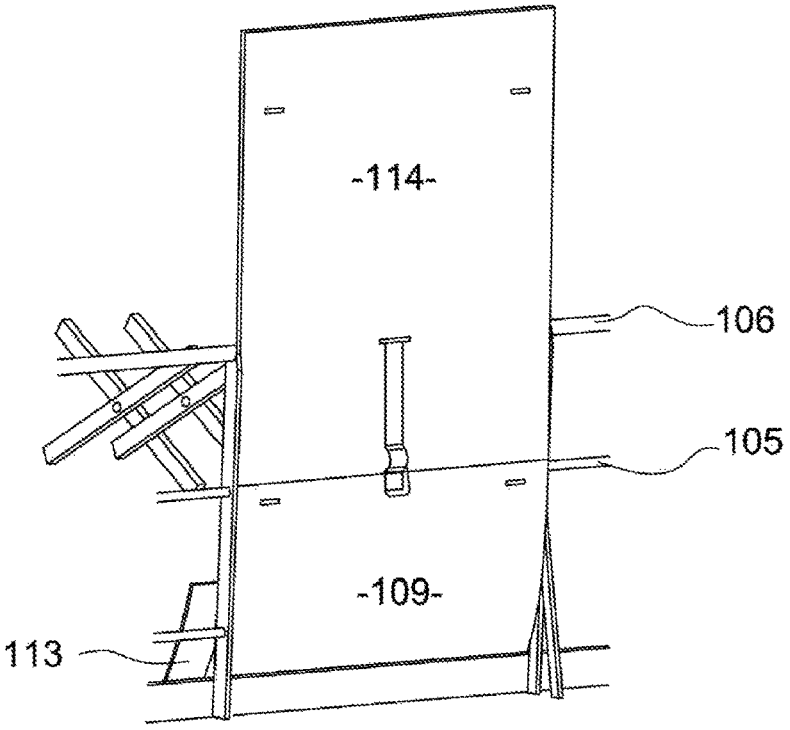
Figure 28B:
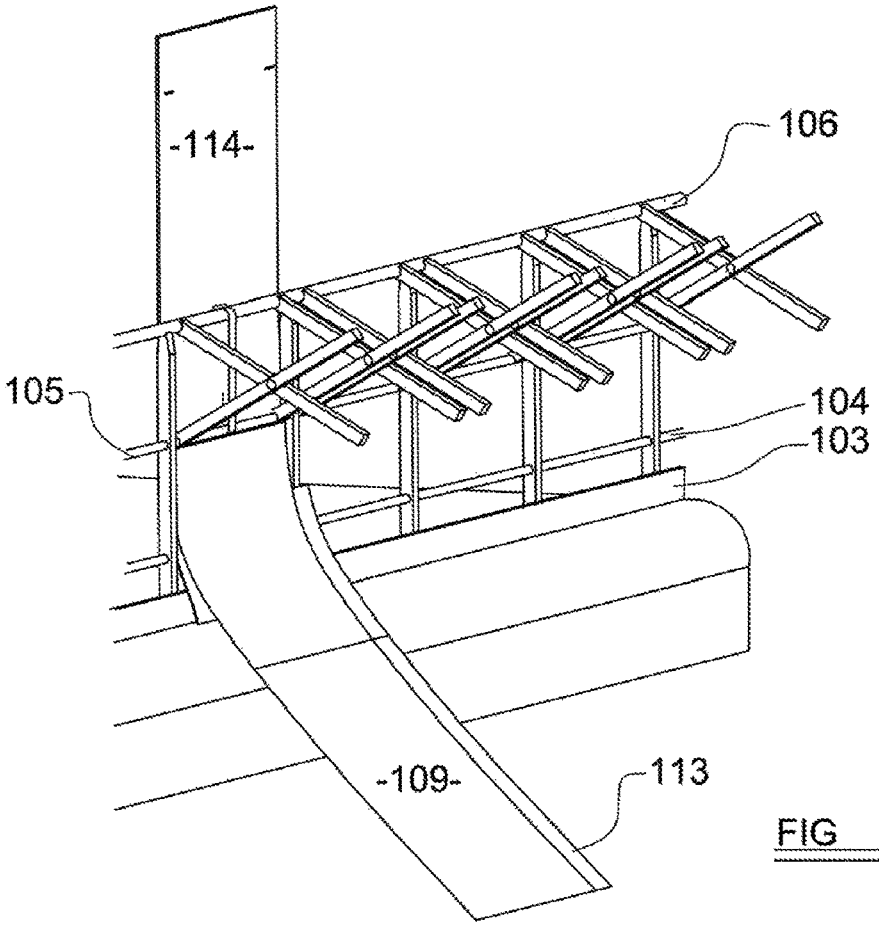

Step 3 is shown in FIGS. 28*a* and 28*b*. FIG. 28*a* shows the arrangement from the inboard side and FIG. 28*b* shows the arrangement from the outboard side. A second sheet of material 114 is attached to the railing 102. The bottom edge 115 of the second sheet 114 rests on the surface of the deck proximal and outboard of the kick plate 103. The second sheet 114 is threaded between the lower rail 104 and the middle rail 105 and has a first slot corresponding to the middle slot of the first sheet 109, and a second slot which is located proximal to the upper rail 106. A strap 110 is threaded through the first and second slots of the second sheet 114 to secure the sheet. Second sheet 114 will eventually become the panel portion of the first device.

In the embodiment shown, the second sheet 114 has a height which is greater than that of the railing 102. In some examples, the height of the second sheet 114 may be around twice that of the railing 102. The second sheet preferably 114 has a width which is equal to or substantially equal to the width of the first sheet 109. The widths of the first and second sheets 109, 114 are preferably substantially aligned with one another.

Figure 29A:
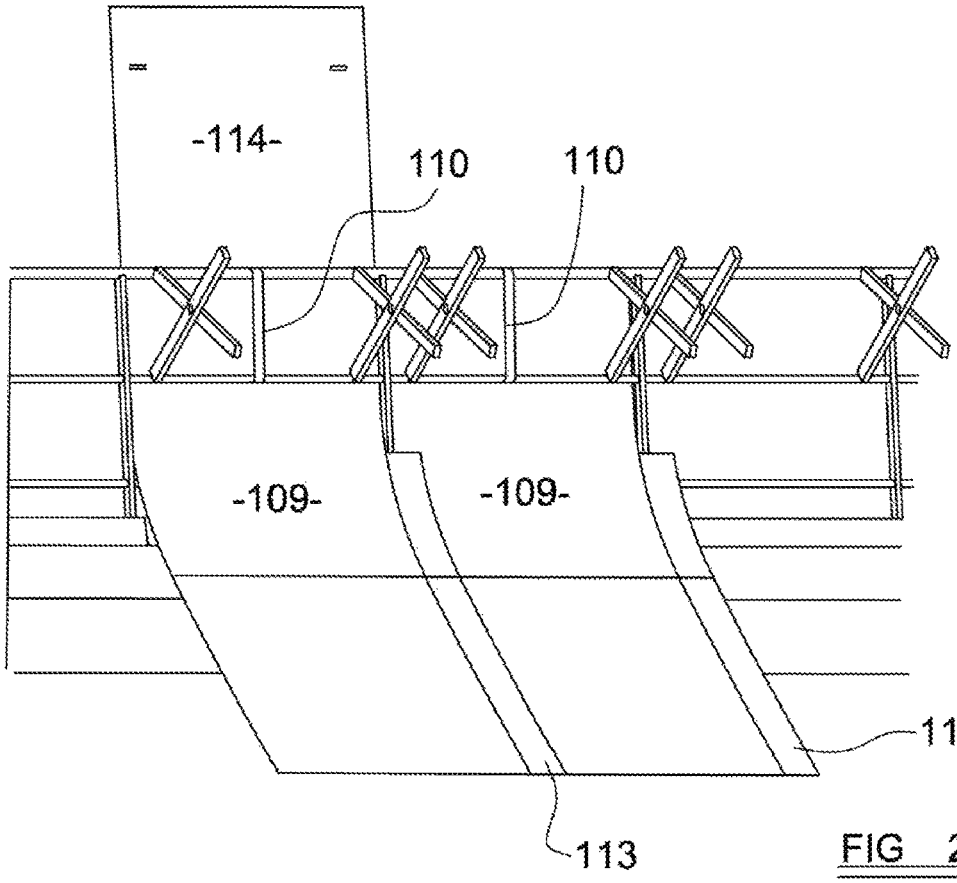
Figure 29B:
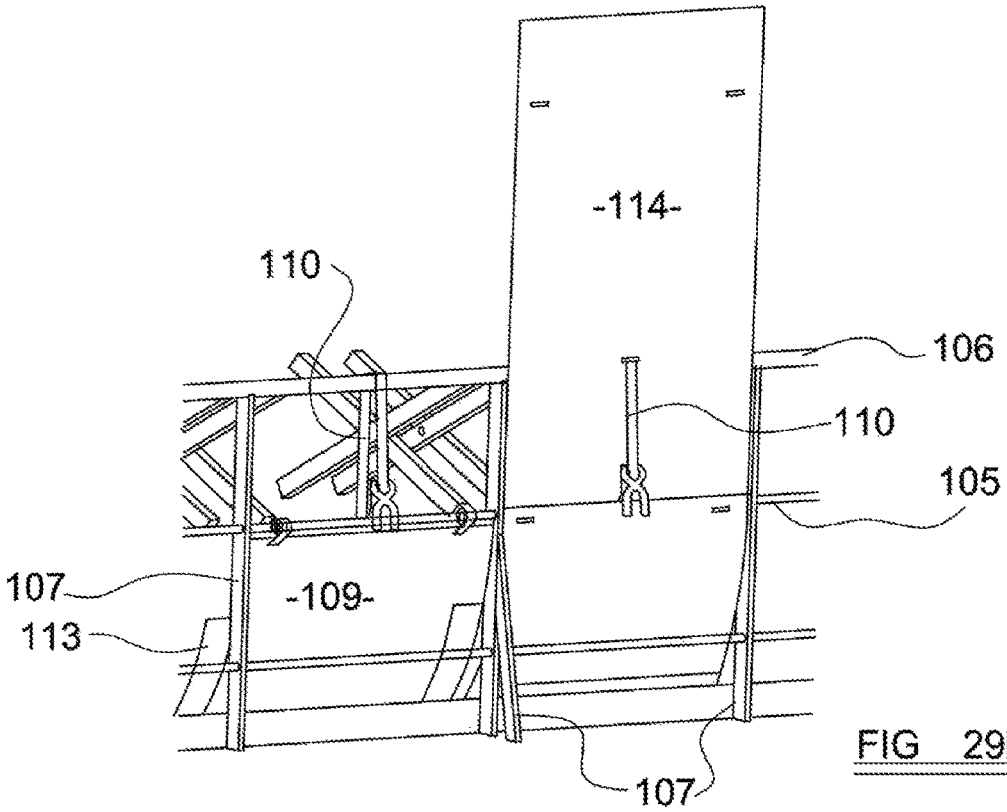

Step 4 is shown in FIGS. 29*a* and 29*b*. FIG. 29*a* shows the arrangement from the outboard side and FIG. 29*b* shows the arrangement from the inboard side. A second barrier sheet 109 is positioned and secured in the adjacent gap between stanchions 107, in similar fashion to the first barrier sheet 109. The second barrier sheet 109 overlaps with the first barrier sheet 109 in overlap region 113. The second barrier sheet 109 will eventually become the barrier of a second device, adjacent to a first device.

Thus, the overlap tab 113 ensures that there are minimal gaps, in the lateral or width direction, between the first and second barrier portions 109 of the first and second devices.

Figure 30:
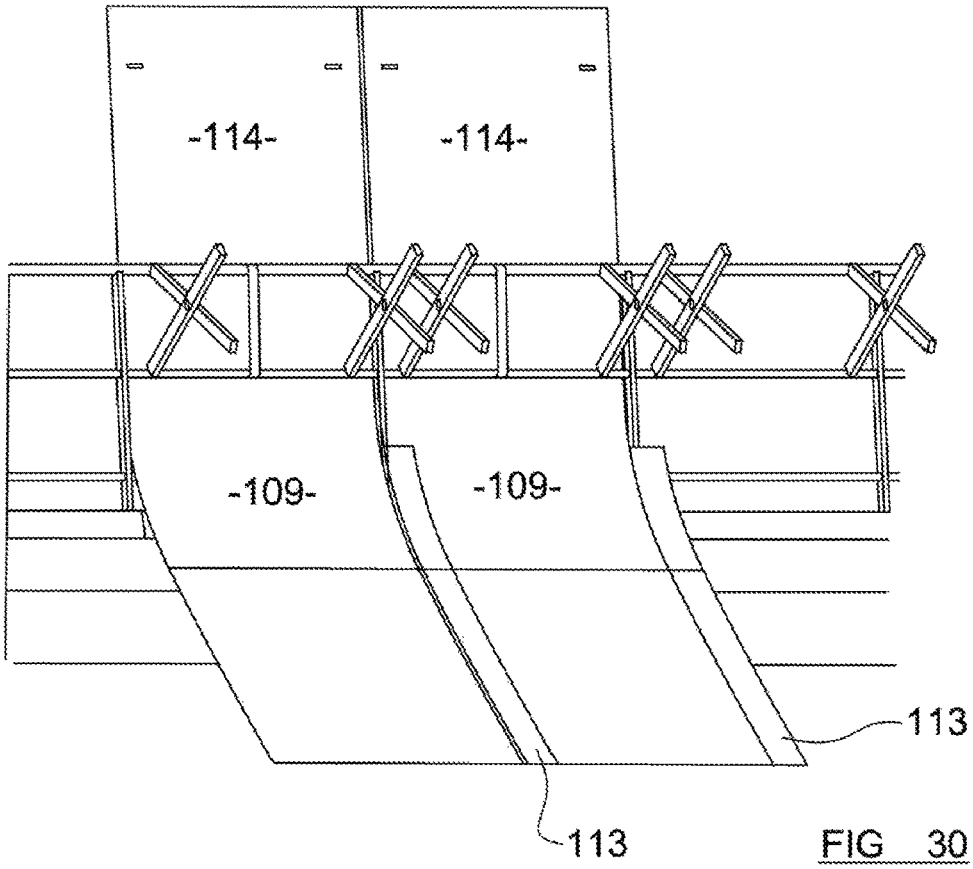

Step 5 is shown in FIG. 30. FIG. 30 shows the arrangement from the outboard side. A second panel sheet 114 is positioned and secured to the adjacent gap between stanchions 107 corresponding to the second barrier sheet 109, in a similar fashion to the first panel sheet 114.

For simplicity only the barriers and panels of first and second devices are shown in this series of figures. The skilled person will appreciate that a series of devices may be assembled, in adjacent gaps between stanchions, along the length of the rail. Each device will have at least some overlap with the next adjacent device. Therefore, the devices are assembled in sequence.

Figure 31A:
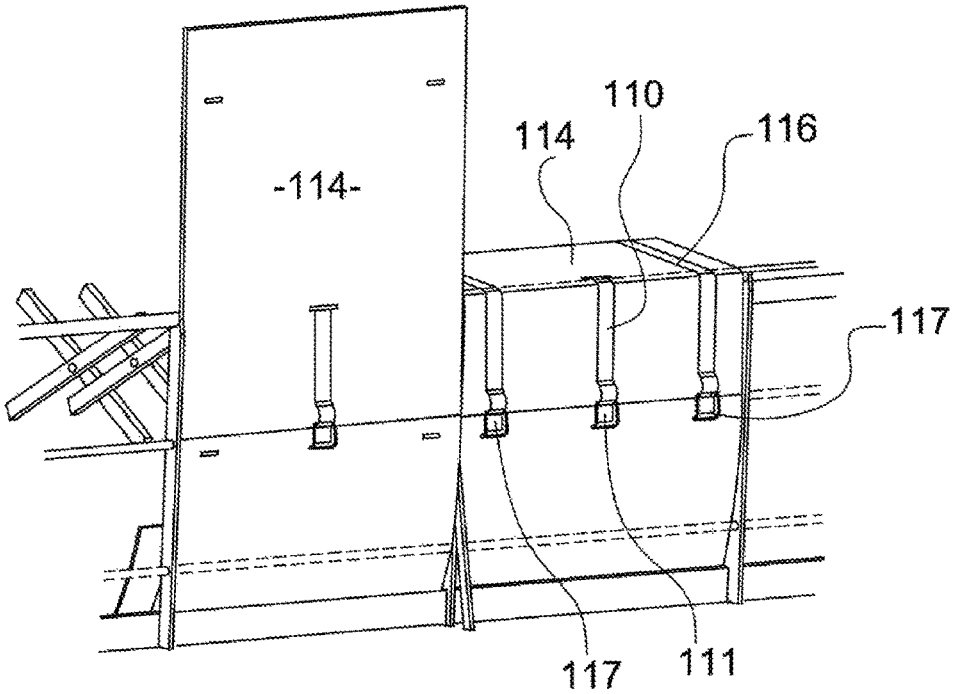
Figure 31B:
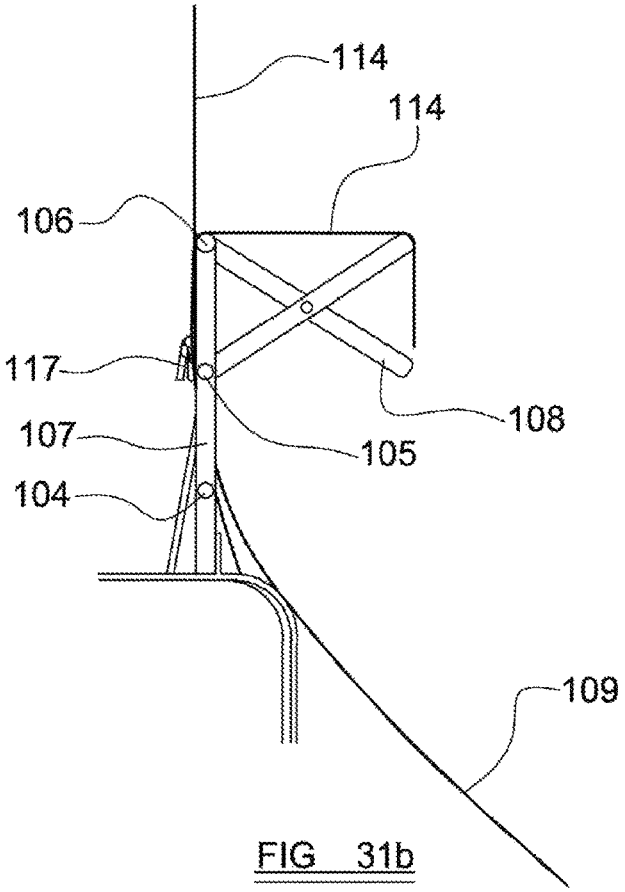
Figure 31C:
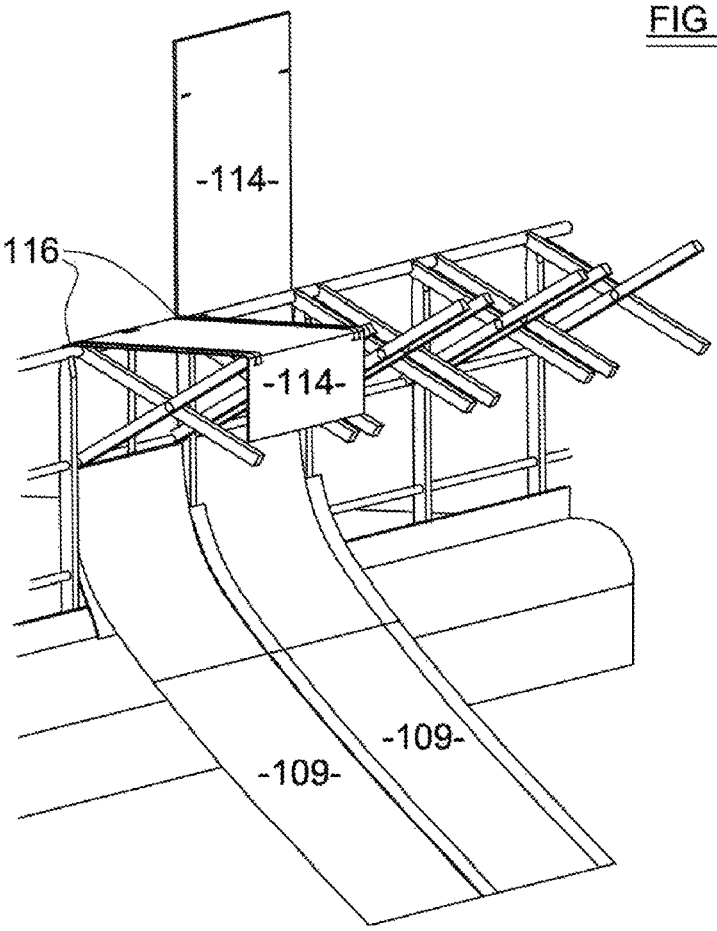

Step 6 is shown in FIGS. 31*a*, 31*b* and 31*c*. FIG. 31*a* shows the arrangement from the inboard side, FIG. 31*b* shows the arrangement from one end and FIG. 31*c* shows the arrangement from the outboard side. Here the panel 114 of the first device is folded outboard over and around the support bars 108. The folded panel 114 is secured in the folded position with two additional straps 116 and corresponding ratchets 117. The straps 116 extend over the top of the folded panel 114, through a slot located near the end of the upper leg of the cross bar 108, along one length of the scissor cross bar and through a slot proximal to the middle rail to be joined to the opposite end of the strap 116 and secured with the ratchet 117.

Figure 32:
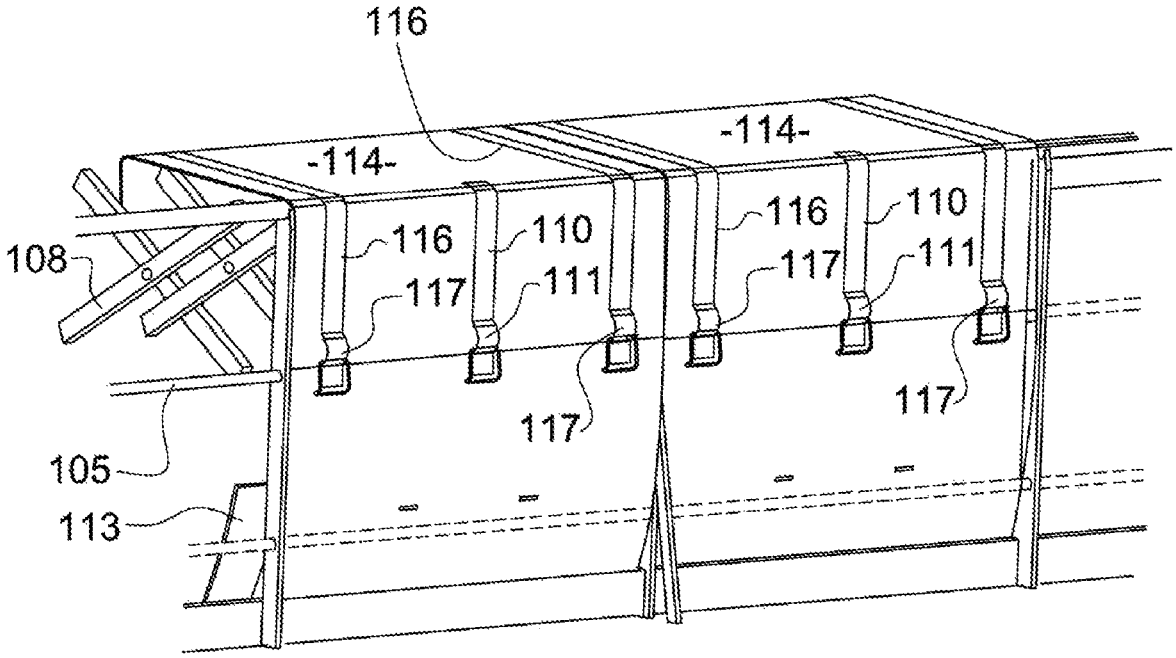

Step 7 is shown in FIG. 32. FIG. 32 shows the arrangement from the inboard side. In similar fashion to step 6, the panel 114 of the second device is folded overboard and around corresponding support bars 108, and secured using additional straps 116 and ratchets 117.

Figure 33A:
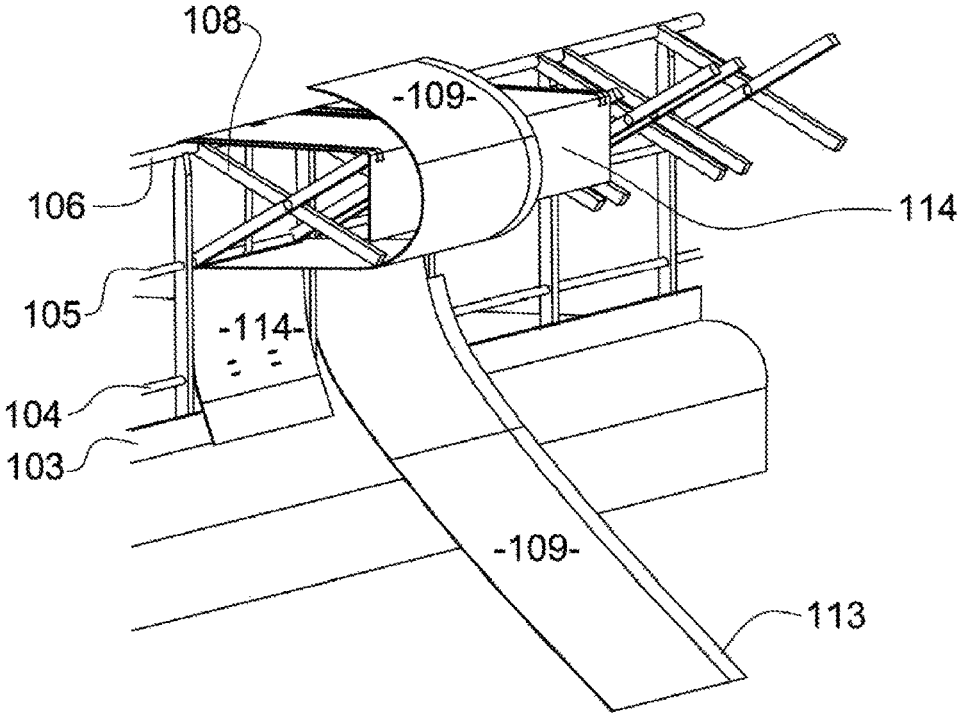
Figure 33B:
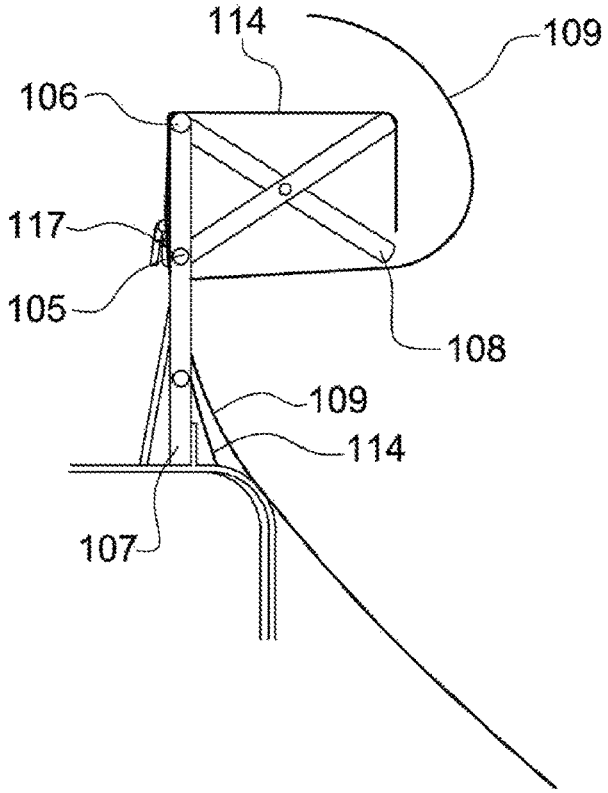
Figure 33C:
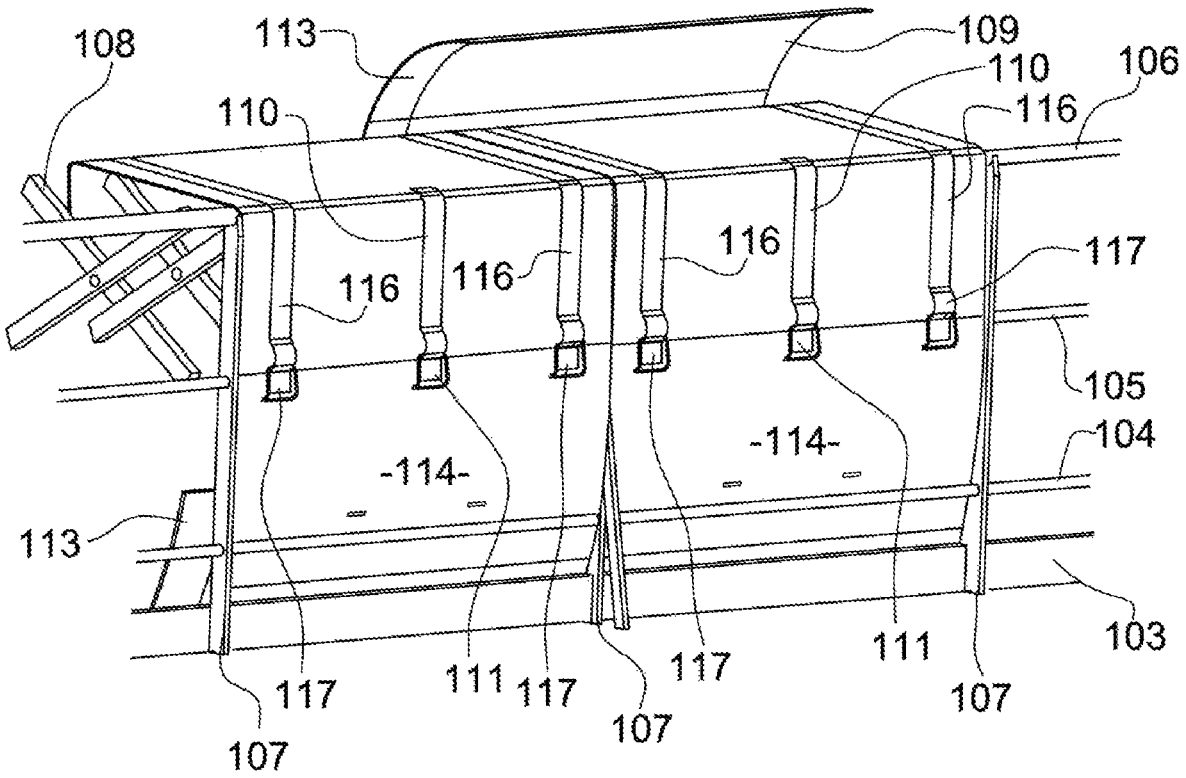

Step 8 is shown in FIGS. 33*a*, 33*b*, and 33*c*. FIG. 33*a* shows the arrangement from the outboard side, FIG. 33*b* shows the arrangement from one end, and FIG. 33*c* shows the arrangement from the inboard side. At this point, the barrier sheet 109 of the first device is pivoted around the middle rail 105 by approximately 90° to extend substantially perpendicularly outwardly from the rail 102. The free end of the sheet 109 is then wrapped around the lower outer leg of the cross bar 108, up and over the upper outer leg of the cross bar 108 and to be positioned above the previously wrapped sheet 114 of the first device.

Figure 34A:
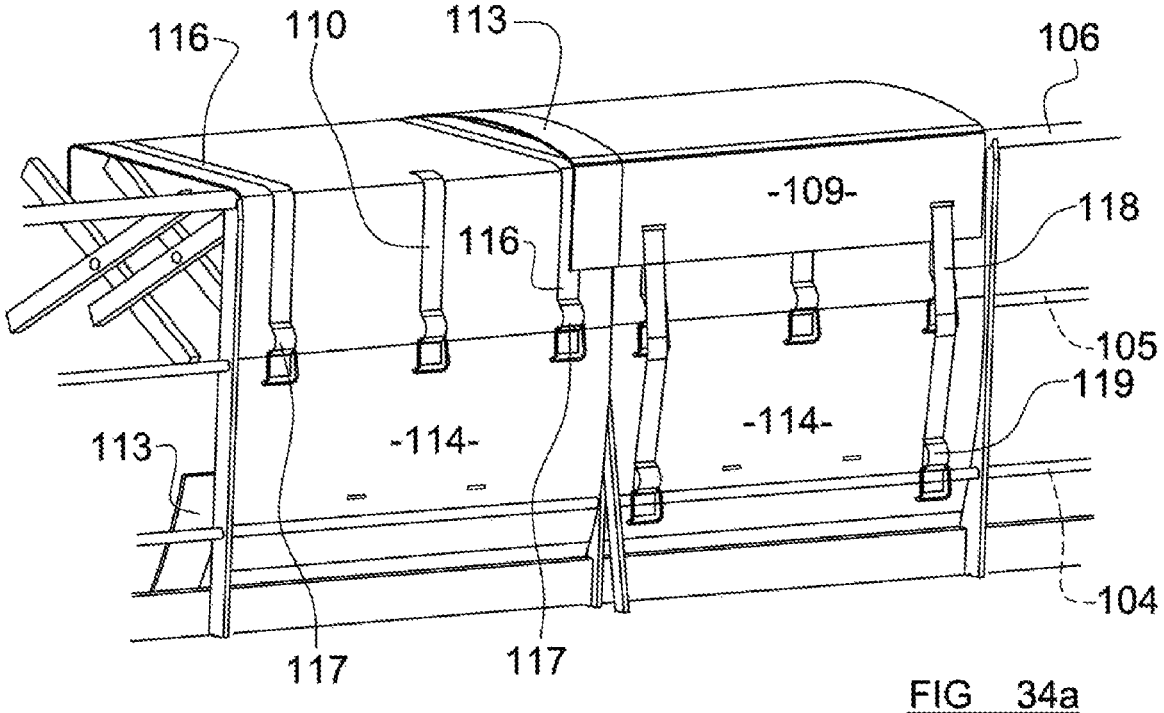
Figure 34B:
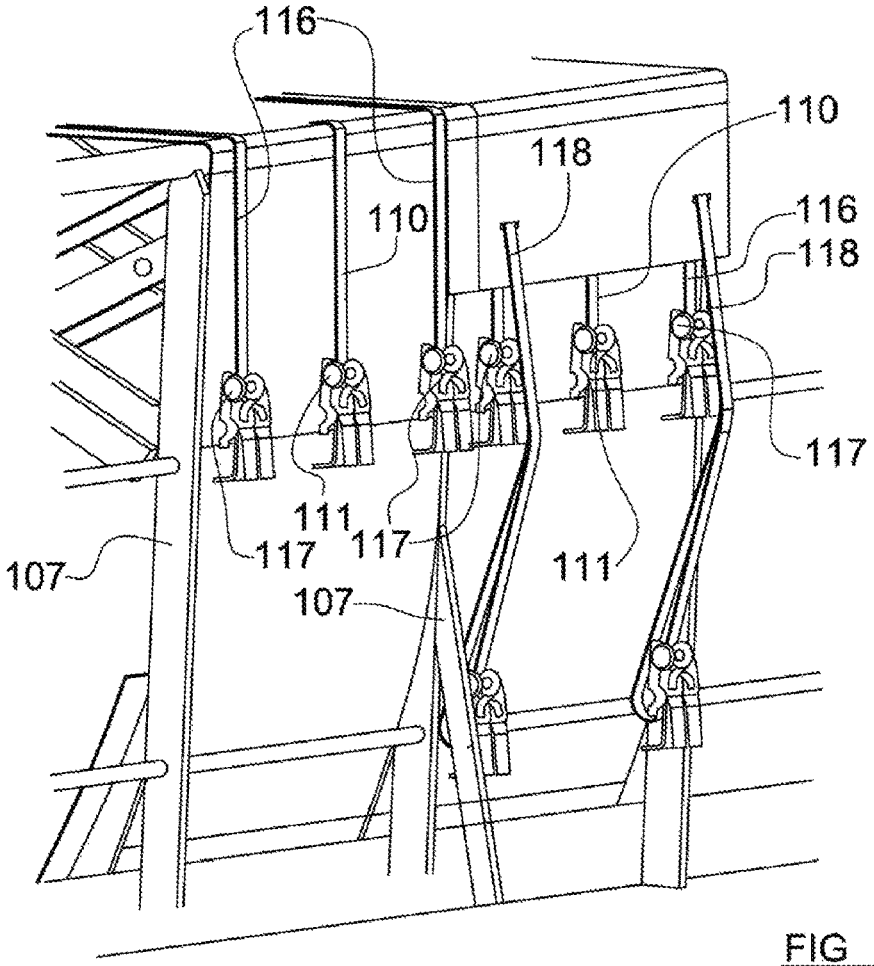
Figure 34C:
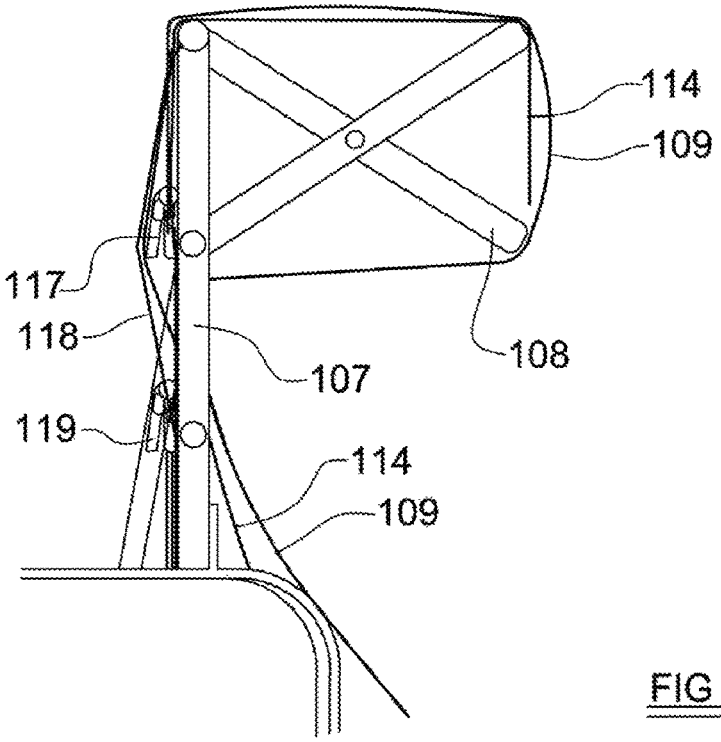

Step 9 is shown in FIGS. 34*a* 34*b* and 34*c*. FIG. 34*a* shows the arrangement from the inboard side, FIG. 34*b* shows a detail from the inboard side and FIG. 34*c* shows the arrangement from one end. At this stage the free end of the barrier sheet 109 of the first device is secured to the rail 102. Two slots located proximal to the fee end and spaced towards edge of the side edges are threaded with further straps 118 and secured with ratchets 119. The straps 118 extend from the slots in the fee end of the barrier 109 and around the lower rail 104. In FIG. 34*a* it can be seen that the tab 113 of the first device partially overlaps and covers the strap 116 of the barrier of the adjacent device. The barrier 109 of the first device also substantially covers the straps 116 of the first device.

Figure 35:
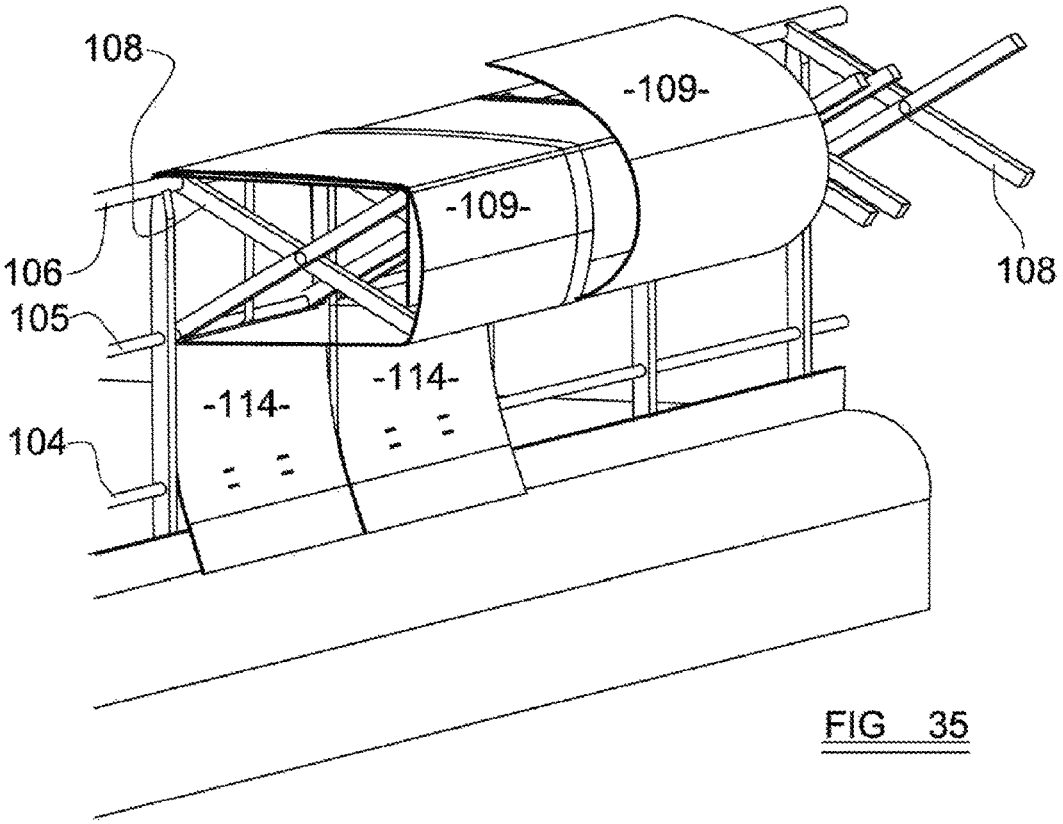

Step 10 is shown in FIG. 35. FIG. 35 shows the arrangement from the outboard side. Here, the barrier sheet 109 of the second, adjacent device is wrapped around the corresponding cross bars 108, in similar fashion to step 8.

Figure 36:
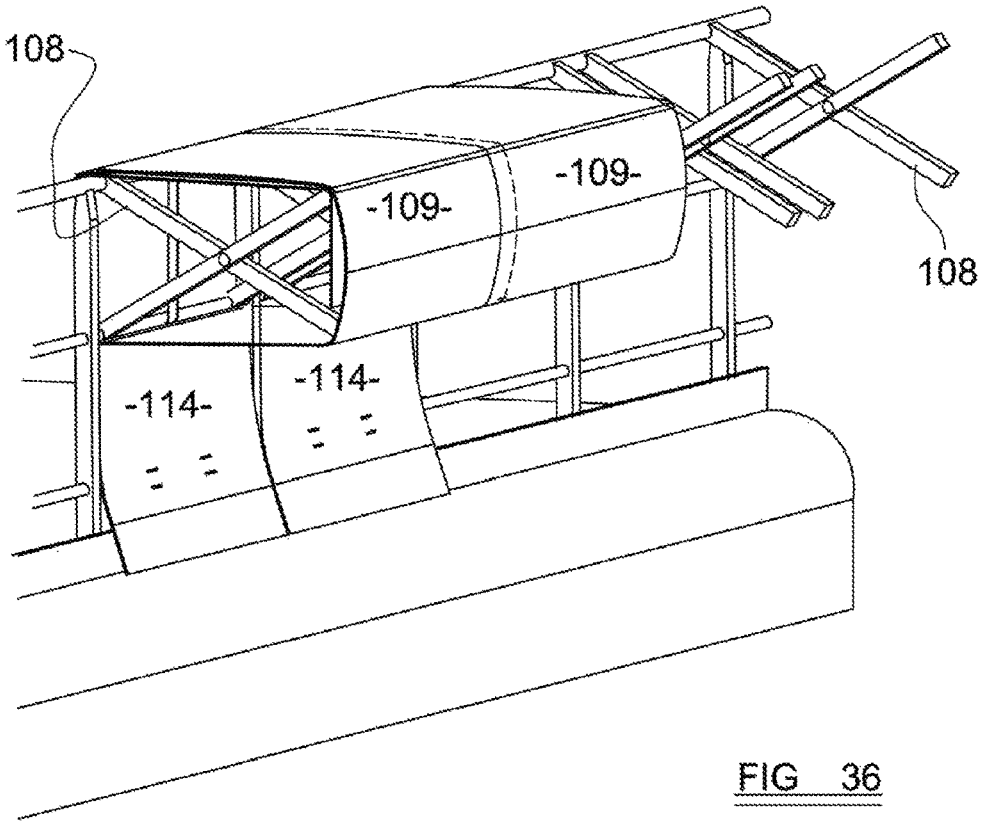

Step 11 is shown in FIG. 36. FIG. 36 shows the arrangement from the outboard side. Here the barrier 109 of the second device is secured in similar fashion to step 10.

Figure 37A:
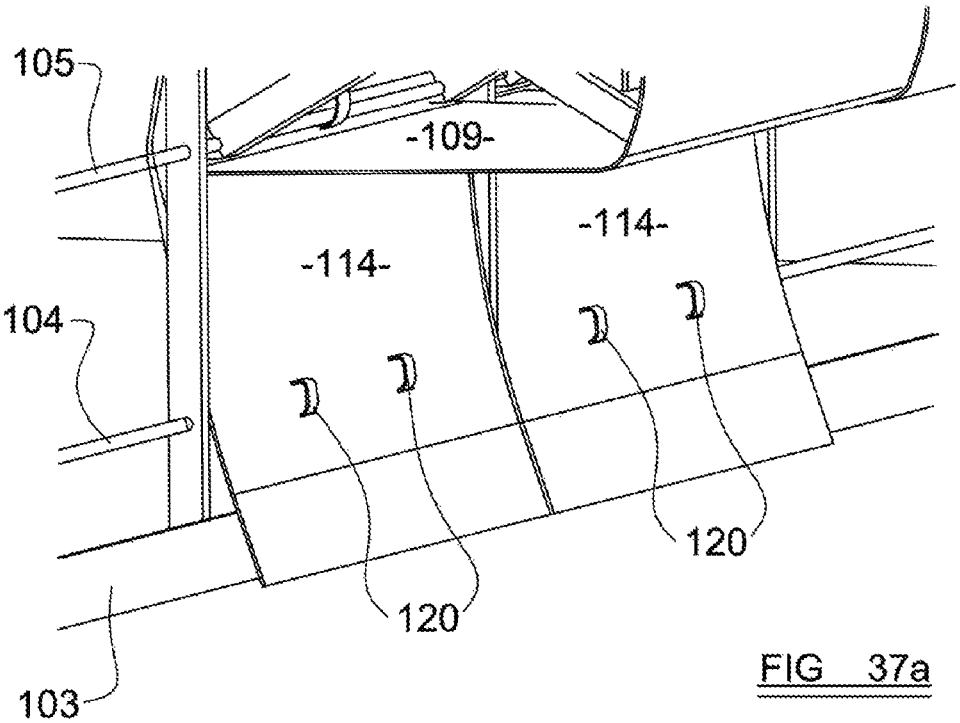
Figure 37B:
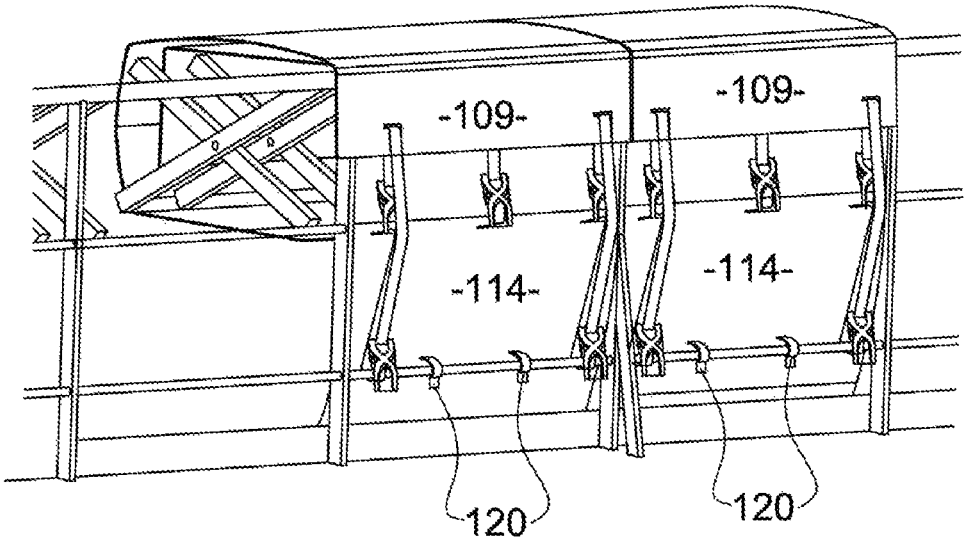

Step 12 is shown in FIGS. 37*a* and 37*b*. FIG. 37*a* shows a detail of the arrangement from the outboard side, and FIG. 37*b* shows the arrangement from the inboard side. Finally, each of the panels 114 are secured to the lower rail 104 through slots with ties 120.

As will be appreciated, the steps 1 to 12 need to be carried out in sequence in order to arrange the components of each device, staring from a first configuration, into the second, assembled, configuration. Certain steps, for example step 12, may be performed out of sequence.

As noted above, preferably (and where this is possible, in view of factors such as the layout of the rails of the ship) at least a portion of each device overlaps with a portion of an adjacent device. This ensures that gaps between the devices are kept to a minimum. For convenience, the width of each of the devices is approximately equal to the space between stanchions.

Generally, for the arrangements described herein, the sides of the devices are open. Where the devices are adjacent the open sides will be obstructed by the next device. At the end of a series of devices arranged side-by-side, inserts or additional panels are preferably provided such that there are no points to attach a grappling hook for other means for trying to gain entry. For example, an insert may have a similar shape to the cross section of the barrier, with a lip for inserting into the cavity of the barrier. The insert would be attached to the barrier using a suitable fastener.

In any of the embodiments described above, additional or alternative straps or fastening arrangements may be used to secure the device further. For example, an additional strap may be used around a middle rail in order to avoid rotation of the panel around the railings.

Additionally, embodiments described herein could include ballistic resistant material for protection from firearms. For example, an additional plate could be attached to the panel, or the panel could be at least in part made from ballistic resistant material.

The security device preferably has a height of around 1-1.3 m, and a width of 1-1.5 m. The top rails provided on cargo ships are typically around 1-1.2 m high, and the security barrier should be formed to be a suitable height to fit onto these rails. A series of security barriers may be provided, adjacent to one another, running along the rail(s) of the ship. Preferably, all rails at the edge of the ship's deck are provided with security barriers. In addition, barriers may be placed on other rails to give an additional layer of protection, for example, on the rails surrounding the entrance to the ship's bridge. In some installations, it may be necessary to provide additional covers for exposed rails on the inboard side of the device so that if a hook is thrown over the device the hook is prevented from catching on the inboard rail.

In preferred embodiments of the invention, the device protrudes outwardly from the panel by a distance of or has a depth of at least 600 mm, preferably more than 700 mm, and yet more preferably more than 750 mm.

It is preferred that the angle of overhang of at least a region of the lower part of the barrier is at least 15° from vertical when the security device is positioned on the ship rails. In embodiments of the invention the angle of overhang may be 25° or more.

The materials from which the security device is formed may allow the components to flex sufficiently to be robust against any knocks which are likely to occur during use, and transportation. In one arrangement, the lower portion of the panel may be made from a more flexible material so that pressure head from water behind the panel is enough to push the lower portion of the panel out to allow the water to drain over the side of the ship, without the need for an opening.

For any of the embodiments described, the simplicity of the shape of the security device allows the security barrier to be installed in either inboard or outboard facing directions on the rails, and without interfering with existing components or equipment of the ship. It would also be possible to install other shaped devices alongside the security devices described herein in order to provide protection to rails which are curved or meet at a corner.

The above description focuses on ships. However, it is also envisaged that the security devices described above may be used with other open water craft such as barges, hovercraft and catamarans. Security devices may be reduced in size suitable for vessels (for example, yachts) that are smaller than full-sized cargo ships. The security devices may also be used in other situations where people may attempt to climb up and over a rail or wall. For instance, the security devices may be used on oil rigs and or other platforms or in prisons.

Certain features of the disclosure are described with reference to certain embodiments and specific figures of the disclosure. It will be apparent that some features are suitable for use with other embodiments and some features are interchangeable.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A ship security device comprising:

a barrier; and a panel having a top and a bottom, wherein the ship security device is able to repeatedly transition between a first configuration and a second configuration, in the first configuration the ship security device is unassembled and at least the barrier is arranged in a storage configuration in which the barrier curves or bends through a first angle, and in the second configuration the ship security device is assembled in an arrangement for use, in which the ship security device is assembled around a rail; and wherein, in the second configuration, at least a part of the panel is orientated to be substantially vertical, and the barrier is curved, bent or folded through a second angle, which is at least 30° greater than the first angle, to protrude away from the panel in a horizontal direction, perpendicular from a plane extending vertically through the rail, to provide an overhang on an exterior side of the rail, and the barrier extends from the top of the panel, protrudes outwardly from the panel and returns to meet the panel at a location between the top of the panel and the bottom of the panel.

2. A ship security device according to claim 1, wherein the second angle is one of:

more than 45° greater than the first angle, or more than 90° greater than the first angle.

3. A ship security device according to claim 1, wherein the first angle is no more than 90°, or is no more than 45°, or is no more than 20°.

4. A ship security device according to claim 1, wherein in the first configuration, the barrier is substantially flat, so that all or substantially all of the barrier lies in or near a single plane.

5. A ship security device according to claim 1, wherein the second angle is more than 90°, or is more than 120°, or is more than 180°.

6. A ship security device according to claim 1, wherein at least part of the barrier is made from a flexible material that may bend into a bulbous shape.

7. A ship security device according to claim 1, wherein the barrier comprises at least one living hinge.

8. A ship security device according to claim 1, wherein the barrier and panel each comprise a substantially planar sheet of material.

9. A ship security device according to claim 1, wherein the barrier and panel comprise a single substantially planar sheet of material.

10. A ship security device according to claim 1, wherein the barrier comprises a comparatively rigid frame structure and a comparatively flexible shell, and the shell at least partially covers the frame structure.

11. A ship security device according to claim 1, wherein the panel is made from a flexible material.

12. A ship security device according to claim 1, wherein the panel may be transitioned repeatedly between the first configuration and the second configuration wherein in the first configuration the panel is curved through a smaller angle than in the second configuration.

13. A ship security device according to claim 1, wherein the panel is made from a rigid material.

14. A ship security device according to claim 1, wherein the panel is curved in the second configuration, such that at least some of an upper portion of the panel is on a first side of the rail, and a lower portion of the panel is on an opposite side of the rail.

15. A ship security device according to claim 1, wherein the barrier is made from a different material compared to the panel, and the barrier is more flexible than the panel.

16. A ship security device according to claim 1, wherein an angle at which the barrier meets the panel in the second configuration at the location between the top of the panel and the bottom of the panel is at least 20° away from being perpendicular to the plane of the panel at that location.

17. A ship security device according to claim 1, further comprising an additional component to be attached to the ship security device, wherein the additional component comprises an anti-ballistic plate.

18. Two or more ship security devices comprising:

a first ship security device comprising:

a barrier; and a panel, wherein, the first ship security device is able to repeatedly transition between a first configuration and a second configuration, in the first configuration the first ship security device is unassembled and at least the barrier is arranged in a storage configuration in which the barrier curves or bends through a first angle, and in the second configuration the first ship security device is assembled in an arrangement for use, in which the first ship security device is assembled around a rail; and wherein, in the second configuration, at least a part of the panel is orientated to be substantially vertical, and the barrier is curved, bent or folded through a second angle, which is at least 30° greater than the first angle, to protrude away from the panel at the top in a horizontal direction, perpendicular from a plane extending vertically through the rail and returns to meet the panel at a location between the top of the panel and a bottom of the panel to provide an overhang on an exterior side of the rail; and a second ship security device, wherein a first side of the first ship security device and a first side of the second ship security device are positioned in close proximity on the rail to form a substantially continuous barrier.

19. A method of installing a ship security device on a railing, comprising the steps of:

providing a ship security device according to claim 1;

initially providing the ship security device in the first configuration; and placing the ship security device in the second configuration, so that it is installed on a railing; and wherein the ship security device is returnable to the first configuration.

20. A method of installing a ship security device on a railing according to claim 19, wherein, starting from the first configuration, the barrier and the panel are placed in an overlapping arrangement and secured to each other using a fastener and a flexible installation member is attached to a free end of the barrier, the ship security device is threaded through the railing leading with the barrier and above the lowest rail and a free end of the flexible installation member is held over the uppermost rail, the ship security device is rotated until the panel is substantially vertical with the lower end of the panel on the outside of the rail and the upper end of the panel extending above the upper rail and on the inside of the rail, further, the securement between the panel and the barrier is located proximate to a middle rail, tension is applied to the flexible installation member to bend the barrier over the top of the panel and into a bulbous shape wherein the upper end of the panel and the free end of the barrier overlap with the panel inside the barrier, and the barrier and the panel are secured to each other and around the railing in the second configuration and the flexible installation member is removed.

21. A method of installing a ship security device according to claim 19, wherein, staring from the first configuration, the method has the steps of:

securing a cross bar support to a railing;

securing a barrier to a middle rail;

securing a panel inboard of the barrier and to an upper rail;

folding the panel over the cross bar; and wrapping the barrier over the cross bar and the panel, and securing the barrier.

22. A method of installing a ship security device according to claim 21 further comprising providing a second ship security device to form a series of security devices in adjacent arrangement.

* * * * *